US009472062B2

(12) United States Patent
DeFrance

(10) Patent No.: US 9,472,062 B2
(45) Date of Patent: Oct. 18, 2016

(54) GAMING SYSTEM AND METHOD PROVIDING A KENO-TYPE PRIMARY GAME ASSOCIATED WITH PERSISTENCE POOLS THAT MAY BE INCREMENTED TO TRIGGER ONE OR MORE BONUSES

(71) Applicant: IGT, Las Vegas, NV (US)

(72) Inventor: Daniel L. DeFrance, Bozeman, MT (US)

(73) Assignee: IGT, Las Vegas, NV (US)

( * ) Notice: Subject to any disclaimer, the term of this patent is extended or adjusted under 35 U.S.C. 154(b) by 263 days.

(21) Appl. No.: 14/455,552

(22) Filed: Aug. 8, 2014

(65) Prior Publication Data

US 2016/0042586 A1 Feb. 11, 2016

(51) Int. Cl.
*G07F 17/32* (2006.01)

(52) U.S. Cl.
CPC ..... *G07F 17/329* (2013.01); *G07F 17/3211* (2013.01)

(58) Field of Classification Search
CPC ..... G07F 17/32
See application file for complete search history.

(56) References Cited

U.S. PATENT DOCUMENTS 4,033,588 A 7/1977 Watts et al.
4,611,811 A 9/1986 Haase et al.
4,661,906 A 4/1987 Difrancesco et al.
4,711,454 A 12/1987 Small
4,747,600 A 5/1988 Richardson et al.
4,775,155 A 10/1988 Lees
4,798,387 A 1/1989 Richardson
4,875,686 A 10/1989 Timms
5,005,840 A 4/1991 Schwartz et al.
5,043,887 A 8/1991 Richardson et al.
5,046,737 A 9/1991 Feinberg
5,072,381 A 12/1991 Richardson et al.
5,100,139 A 3/1992 Di Bella
5,116,049 A 5/1992 Sludikoff et al.
5,158,293 A 10/1992 Mullins
5,280,909 A 1/1994 Tracy et al.
5,351,970 A 10/1994 Fioretti et al.
5,364,104 A 11/1994 Jones et al.
5,377,973 A 1/1995 Jones et al.
5,401,024 A 3/1995 Simunek
5,419,592 A 5/1995 Stuart
5,482,289 A 1/1996 Weingardt et al.
5,569,083 A 10/1996 Fioretti et al.
5,586,937 A 12/1996 Menashe
5,639,089 A 6/1997 Matsumoto et al.
5,647,798 A 7/1997 Falciglia (Continued)

*Primary Examiner* — Omkar Deodhar
(74) *Attorney, Agent, or Firm* — Neal, Gerber & Eisenberg LLP

(57) ABSTRACT

Various embodiments of the present disclosure are directed to a gaming system and method providing a keno-type primary game including designated values that may be accumulated to trigger one or more bonuses. In one embodiment, the gaming system is configured to operate a keno-type primary game and a plurality of bonuses. Each bonus is associated with a different one of a plurality of different designated values. The gaming system accumulates the designated values upon the occurrence of certain events during play of the primary game. When the gaming system accumulates a designated quantity of a particular designated value during play of the primary game, the gaming system provides the bonus associated with that designated value. The gaming system thus enables accumulation of designated values across a plurality of plays of the primary game and, in some instances, over a plurality of gaming sessions to attempt to trigger the bonuses.

20 Claims, 23 Drawing Sheets

(56) References Cited

U.S. PATENT DOCUMENTS 5,651,735 A 7/1997 Baba
5,679,077 A 10/1997 Pocock et al.
5,687,971 A 11/1997 Khaladkar
5,718,631 A 2/1998 Invencion et al.
5,727,786 A 3/1998 Weingardt et al.
5,743,526 A 4/1998 Inoue
5,755,619 A 5/1998 Matsumoto et al.
5,766,076 A 6/1998 Pease et al.
5,779,545 A 7/1998 Berg et al.
5,823,534 A 10/1998 Banyai et al.
5,833,537 A 11/1998 Barrie
5,855,515 A 1/1999 Pease et al.
5,857,911 A 1/1999 Fioretti et al.
5,871,398 A 2/1999 Schneier et al.
5,885,158 A 3/1999 Torango et al.
5,909,875 A 6/1999 Weingardt et al.
5,935,001 A 8/1999 Baba et al.
5,935,002 A 8/1999 Falciglia
5,945,655 A 8/1999 Gilgeous et al.
5,947,820 A 9/1999 Morro et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A 8/2000 Scott et al.
6,146,272 A 11/2000 Walker et al.
6,146,273 A 11/2000 Olsen et al.
6,168,521 B1 1/2001 Luciano et al.
6,183,361 B1 2/2001 Cummings et al.
6,210,275 B1 4/2001 Olsen
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 11/2001 Roethel et al.
6,315,291 B1 11/2001 Moody
6,325,716 B1 12/2001 Walker et al.
6,358,151 B1 3/2002 Enzminger et al.
6,364,313 B1 4/2002 Moody
6,368,213 B1 4/2002 McNabola
6,368,214 B1 4/2002 Luciano
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,599,193 B2 7/2003 Baerlocher et al.
6,607,440 B2 8/2003 Santini, Jr.
6,609,973 B1 8/2003 Weiss
6,645,072 B1 11/2003 Kellen
6,656,044 B1 12/2003 Lewis
6,656,045 B2 12/2003 Wei et al.
6,722,655 B1 4/2004 Camero
6,726,563 B1 4/2004 Baerlocher et al.
6,755,738 B2 6/2004 Glasson et al.
6,755,739 B2 6/2004 Santini, Jr.
6,758,747 B2 7/2004 Baerlocher
6,780,108 B1 8/2004 Luciano, Jr. et al.
6,796,899 B2 9/2004 Baerlocher
6,802,776 B2 10/2004 Lind et al.
6,824,465 B2 11/2004 Luciano, Jr.
6,832,956 B1 12/2004 Boyd et al.
6,840,858 B2 1/2005 Adams
7,258,608 B2 8/2007 Khal
7,297,059 B2 11/2007 Vancura et al.
7,303,469 B2 12/2007 Kaminkow
7,306,519 B2 12/2007 Baerlocher
7,357,716 B2 4/2008 Marks et al.
7,399,227 B2 7/2008 Michaelson et al.
7,470,184 B2 12/2008 Baerlocher et al.
7,544,129 B2 6/2009 Baerlocher
7,597,621 B2 10/2009 Baerlocher
7,651,392 B2 1/2010 Pennington et al.
7,666,093 B2 2/2010 Lafky et al.
7,674,180 B2 3/2010 Graham et al.
7,682,241 B2 3/2010 Baerlocher
7,682,248 B2 3/2010 Baerlocher et al.
7,780,520 B2 8/2010 Baerlocher
7,824,257 B2 11/2010 Jubinville et al.
7,841,939 B2 11/2010 Baerlocher et al.
7,862,430 B2 1/2011 Baerlocher et al.
7,901,282 B2 3/2011 Cannon
7,914,377 B2 3/2011 Benbrahim et al.
7,942,737 B2 5/2011 Cregan et al.
7,963,845 B2 6/2011 Baerlocher
7,985,133 B2 7/2011 Baerlocher et al.
8,002,620 B2 8/2011 Nicely et al.
8,025,561 B2 9/2011 Reddicks et al.
8,033,903 B2 10/2011 Cregan
8,070,597 B2 12/2011 Cuddy
8,092,302 B2 1/2012 Cuddy et al.
8,096,874 B2 1/2012 Nicely et al.
8,113,939 B2 2/2012 Cannon
8,123,604 B2 2/2012 Lancaster et al.
8,128,491 B2 3/2012 Vasquez et al.
8,152,630 B2 4/2012 Cohen
8,157,646 B2 4/2012 Pawloski et al.
8,172,660 B2 5/2012 Lancaster et al.
8,197,337 B2 6/2012 DeWaal et al.
8,210,937 B2 7/2012 Cregan et al.
8,231,453 B2 7/2012 Wolf et al.
8,376,836 B2 2/2013 Baerlocher et al.
8,382,572 B2 2/2013 Hoffman et al.
8,425,303 B2 4/2013 Kennedy et al.
8,500,548 B2 8/2013 Baerlocher et al.
2002/0045472 A1 4/2002 Adams
2002/0052231 A1 5/2002 Fioretti
2002/0094859 A1 7/2002 Hirsch et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0017867 A1 1/2003 deKeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.

(56) References Cited

U.S. PATENT DOCUMENTS

| | | | |
|---|---|---|---|
| 2005/0059449 | A1 | 3/2005 | Yarbrough |
| 2005/0059467 | A1 | 3/2005 | Saffari et al. |
| 2005/0059469 | A1 | 3/2005 | Gail et al. |
| 2005/0059470 | A1 | 3/2005 | Cannon |
| 2005/0059471 | A1 | 3/2005 | Cannon |
| 2005/0064932 | A1 | 3/2005 | Cannon |
| 2005/0075161 | A1 | 4/2005 | McGlone et al. |
| 2005/0096119 | A1 | 5/2005 | Lind et al. |
| 2005/0096123 | A1 | 5/2005 | Cregan et al. |
| 2005/0101370 | A1 | 5/2005 | Lind et al. |
| 2005/0101387 | A1 | 5/2005 | Wolf |
| 2005/0119042 | A1 | 6/2005 | Chamberlain et al. |
| 2005/0130730 | A1 | 6/2005 | Lind et al. |
| 2005/0148382 | A1 | 7/2005 | Fox |
| 2005/0164771 | A1 | 7/2005 | Lind et al. |
| 2005/0164772 | A1 | 7/2005 | Lind et al. |
| 2005/0164773 | A1 | 7/2005 | Lind et al. |
| 2005/0167916 | A1 | 8/2005 | Banyai |
| 2005/0187014 | A1 | 8/2005 | Saffari et al. |
| 2005/0227753 | A1 | 10/2005 | Luciano |
| 2005/0255906 | A1 | 11/2005 | Lind et al. |
| 2006/0084490 | A1 | 4/2006 | Khal |
| 2006/0189375 | A1 | 8/2006 | Dodge |
| 2007/0021185 | A1 | 1/2007 | Walker et al. |
| 2007/0052172 | A1 | 3/2007 | Dargue |
| 2007/0117611 | A1 | 5/2007 | Dodge |
| 2008/0076542 | A1 | 3/2008 | Iddings et al. |
| 2008/0090651 | A1 | 4/2008 | Baerlocher |
| 2008/0102952 | A1 | 5/2008 | Walker et al. |
| 2008/0108430 | A1 | 5/2008 | Evans |
| 2008/0108431 | A1 | 5/2008 | Cuddy et al. |
| 2008/0254894 | A1 | 10/2008 | Michaelson et al. |
| 2009/0042645 | A1 | 2/2009 | Graham et al. |
| 2009/0075715 | A1 | 3/2009 | Coleman et al. |
| 2009/0124362 | A1 | 5/2009 | Cuddy et al. |
| 2009/0124364 | A1 | 5/2009 | Cuddy et al. |
| 2009/0197664 | A1 | 8/2009 | Schultz |
| 2010/0081497 | A1 | 4/2010 | Wolf et al. |
| 2010/0120489 | A1 | 5/2010 | Meyer |
| 2011/0003627 | A1 | 1/2011 | Nicely et al. |
| 2011/0003637 | A1 | 1/2011 | LeFever |
| 2011/0028201 | A1 | 2/2011 | Warner et al. |
| 2011/0111843 | A1 | 5/2011 | Nicely et al. |
| 2013/0079123 | A1 | 3/2013 | Nicely et al. |
| 2014/0018146 | A1 | 1/2014 | Zielinski et al. |

1116,1118
200
210b
220c
220g
220h
220i
220a
210a
220b
220f
220m
220j
220n
220d
210c
220e
220k
220l
210f
220t
210g
220s
220r
220q
220p
210e
220o
210d
HIT
K◇
6♡
3◇
8◇
2◇
10♧
Q♡
Award
0
Bet
8
Credit
992
King Bonus
Queen Bonus
Jack Bonus
Ace Bonus
K
Q
Start
Clear
Quick Pick
Hits
Win
4 1
5 5
6 25
7 120
8 500
9 2000
10 10000
230
230a
240
240a
250
260
270
282
284
286
292
294
296

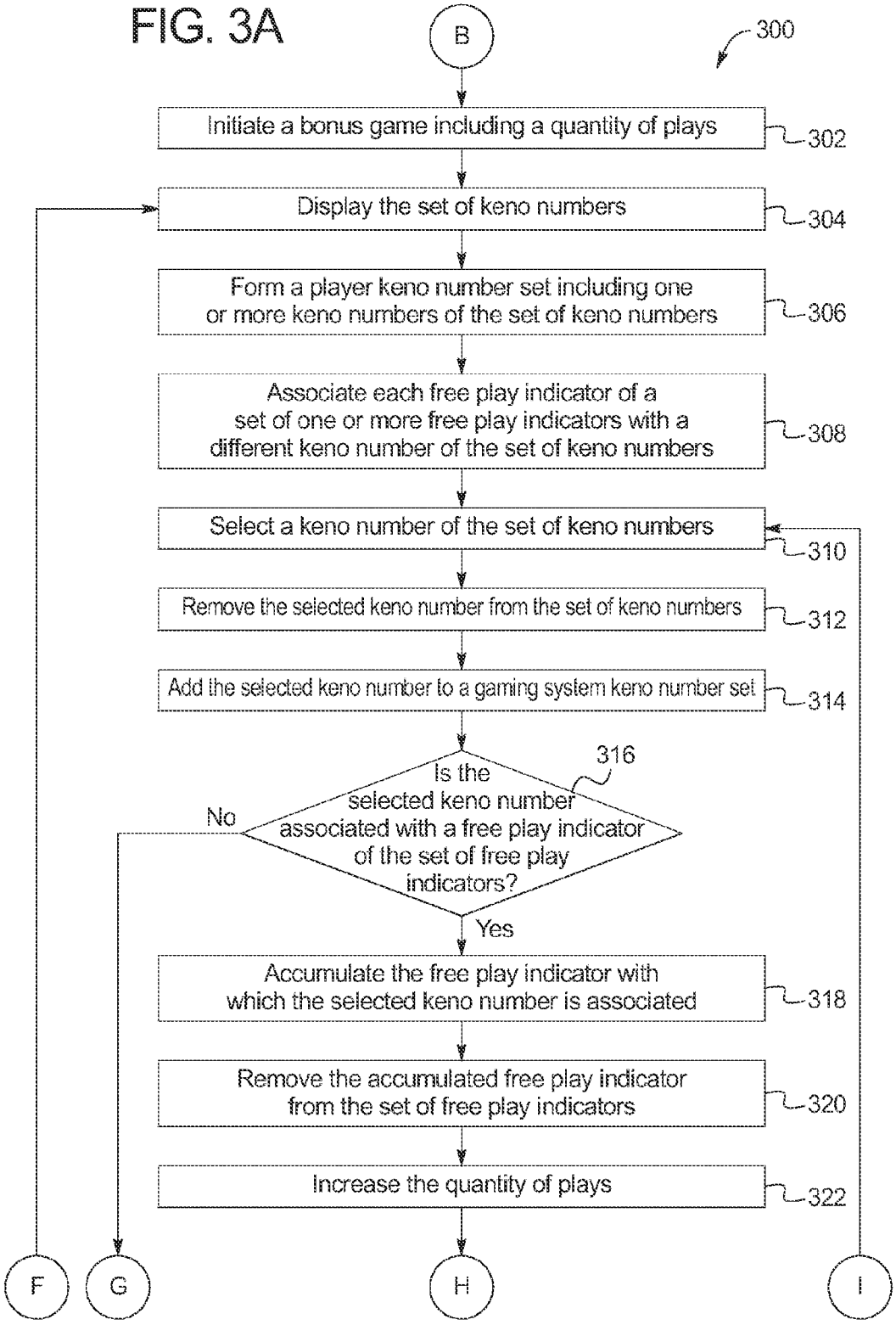
FIG. 3A
B
300
Initiate a bonus game including a quantity of plays
302
Display the set of keno numbers
304
Form a player keno number set including one or more keno numbers of the set of keno numbers
306
Associate each free play indicator of a set of one or more free play indicators with a different keno number of the set of keno numbers
308
Select a keno number of the set of keno numbers
310
Remove the selected keno number from the set of keno numbers
312
Add the selected keno number to a gaming system keno number set
314
316
Is the selected keno number associated with a free play indicator of the set of free play indicators?
No
Yes
Accumulate the free play indicator with which the selected keno number is associated
318
Remove the accumulated free play indicator from the set of free play indicators
320
Increase the quantity of plays
322
F
G
H
I

GAMING SYSTEM AND METHOD PROVIDING A KENO-TYPE PRIMARY GAME ASSOCIATED WITH PERSISTENCE POOLS THAT MAY BE INCREMENTED TO TRIGGER ONE OR MORE BONUSES

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the U.S. Patent and Trademark Office patent file or records, but otherwise reserves all copyright rights whatsoever.

BACKGROUND

Keno in the United States traces back to a "Chinese lottery" game brought to the United States by Chinese immigrants in the 1800s. The "Chinese lottery" game utilized a board and a set of up to 120 characters instead of numbers. Early versions of American keno used characters on keno tickets rather than the numbers used today. The American keno game reduced the number of characters to the more familiar eighty.

When gambling was legalized in the state of Nevada in 1931, the "Chinese lottery" game was instead referred to as "Horse Race Keno," reflecting the idea that the numbers are horses and the players want their wagered-on horses to come in. Later, the name was shortened to simply keno, although the game is still often referred to as "Horse Race Keno."

Keno is similar to a lottery. The goal in keno, like in a lottery, is for a player to choose winning numbers from a plurality of numbers. In most standard versions of paper or video based keno, a player receives a card with eighty squares numbered one to eighty and arranged in eight rows of ten squares. The player can wager on any number or numbers up to a designated quantity of numbers, such as ten numbers. The player chooses numbers on which the player desires to wager by marking those numbers on a keno card (such as in a paper version of keno) or by selecting the numbers on a keno display (such as in a video version of keno). A clerk or the processor of the video display records the player's wager(s). The player pays for each number played or wagered on.

In one known paper version, the keno numbers also appear on eighty ping pong type balls that can be tossed about in a clear plastic sphere or spun around in a wire bird cage. Keno numbers were at one time drawn from such apparatuses without replacement using a manually powered keno goose. In one known video version, a computer generates the keno numbers without replacement using a random number generator. After a number is chosen, that number is shown electronically on keno boards throughout the casino or on the video display. An award is provided to the player based on a quantity of matches between the player selected number(s) and the game generated number(s).

Many casinos offer "multi-race" cards that enable the player to play the same set of numbers over multiple games. One type of "multi-play" game enables the player to wager on a single set of numbers over as many as twenty games. When finished, the player must return to the keno station and cash in any wins. "Stray and play" tickets are also available, and enable the player to play a version of keno called "walk away keno." Here, players can purchase a keno ticket for an extended number of games, enjoy other activities in the casino, and return at a later time or even a later date to have the tickets checked by a computer for winning games.

Another option for keno players is a combination or "way" ticket. A combination ticket enables the player to group different numbers, wherein each group has the same amount numbers, creating more than one way to win. For example, a 3×3×3, nine spot ticket enables the player to select a combination of three groups of three numbers. The player can, for example, mark a first group of three numbers with the letter "A," mark a second group with the letter "B," and mark a third group the letter "C." This ticket enables the player to win on any winning combination of three numbers for any of the three groups. Hitting any winning combination pays as though a single ticket had been played. Essentially, the player plays three games on one card. In some keno games, playing three numbers in three games enables the player to play, or provides to the player, an additional nine spot game.

The "way" ticket supposedly makes keno more exciting, enabling players to wager more money on more numbers. In reality, playing a way or combination ticket offers no mathematical advantage, and no disadvantage, to the player. Some casinos offer discounted minimum wagers with "way" tickets. If the player plays three or more ways, many casinos will discount the price per "way" (e.g., let the player wager $0.50 per wager instead of a usual $1 minimum). However, the casino only pays back on the player's actual wager.

Certain variations of keno have expected returns that are relatively constant regardless of how many numbers the player plays. That is, it does not mathematically matter how many numbers the player chooses or if the player combines wagers. The player can choose fewer numbers if the player likes to win a smaller amount but a little more often. The player can choose more numbers if the player does not care about the frequency of the wins but wants bigger payouts. In other versions, the expected value fluctuates based on how many numbers the player plays.

Keno is a popular game that has been embodied in various types of gaming systems. A need exists to provide variations of keno and keno gaming systems and methods to make the play of keno more enjoyable, fun, and exciting for players.

SUMMARY

Various embodiments of the present disclosure are directed to a gaming system and method providing a keno-type primary game associated with persistence pools values that may be incremented to trigger one or more bonuses.

Generally, in various embodiments, the gaming system of the present disclosure is configured to operate a keno-type primary game associated with a plurality of different incrementable persistence pools. Each persistence pool is associated with a different one of a plurality of different designated values and a different one of a plurality of different bonuses. For each persistence pool, the gaming system increments that persistence pool when a certain event associated with the corresponding designated value occurs during play of the keno-type primary game. For each persistence pool, the gaming system provides the bonus associated with that persistence pool when that persistence pool increments to a designated value. The gaming system of the present disclosure thus enables persistence pools to be incremented across a plurality of plays of the keno-type primary game and, in some instances, over a plurality of gaming sessions to attempt to trigger the bonuses.

More specifically, in various embodiments, the gaming system of the present disclosure is configured to operate a keno-type primary game associated with a plurality of different persistence pools. Each persistence pool is associated with a different one of a plurality of different designated values and one of a plurality of different keno-type bonus games (i.e., bonuses in these embodiments). The gaming system increments the persistence pools by accumulating the designated values upon the occurrence of certain events during play of the keno-type primary game. When the gaming system accumulates a designated quantity of a particular designated value (i.e., when a particular persistence pool increments to the designated quantity in these embodiments), the gaming system provides the keno-type bonus game associated with that particular designated value. In these embodiments, the gaming system of the present disclosure thus enables accumulation of designated values across a plurality of plays of the keno-type primary game and, in some instances, over a plurality of gaming sessions to attempt to trigger the keno-type bonus game(s).

In certain embodiments in which the keno-type primary game is associated with a plurality of different keno-type bonus games, the keno-type bonus games have different average expected payback percentages and different probabilities of being triggered. Additionally, in these embodiments, the average expected payback percentage of a keno-type bonus game is inversely proportional to the probability of being triggered of the keno-type bonus game such that more easily triggered keno-type bonus games have lower average expected payback percentages, and vice-versa. Thus, in these embodiments, the gaming system enables players to trigger certain less valuable keno-type bonus games more often than other more valuable keno-type bonus games.

In operation of one embodiment, for a play of the keno-type primary game, the gaming system: (1) enables a player to form a player keno number set from a plurality of keno numbers (such as the numbers 1 through 80), (2) randomly selects a gaming system number set from the plurality of keno numbers, and (3) determines any primary awards for the play of the keno-type primary game based on how many of the same numbers are included in both the player keno number set and the gaming system number set. In this embodiment, at one or more points during play, the gaming system associates one or more values of a set of a plurality of different values (such as a set of the plurality of card values of the cards of a fifty-two card deck) with one or more of the keno numbers. The set of values includes a plurality of non-designated values (such as the playing card values Two through Ten) and a plurality of different designated values (such as the playing card values Jack through Ace). Each designated value is associated with a different one of a plurality of different keno-type bonus games. In this embodiment, when the gaming system selects a keno number associated with a designated value to include in the gaming system keno number set, the gaming system accumulates that designated value. When the gaming system selects a keno number associated with a non-designated value to include in the gaming system keno number set, the gaming system associates at least one value with at least one keno number.

In this embodiment, when the player accumulates a designated quantity of the designated value associated with a particular keno-type bonus game, the gaming system provides that keno-type bonus game. The keno-type bonus game is associated with a quantity of one or more free plays. For each free play, the gaming system: (1) enables a player to form a player keno number set from a plurality of keno numbers, (2) randomly selects a gaming system number set from the plurality of keno numbers, and (3) determines any bonus awards for the free play based on how many of the same numbers are included in both the player keno number set and the gaming system number set. The gaming system associates one or more non-accumulated free play indicators of a set of one or more free play indicators with one or more of the keno numbers. In this embodiment, when the gaming system selects a keno number associated with a free play indicator to include in the gaming system keno number set, the gaming system accumulates that free play indicator and increases the quantity of free plays associated with the keno-type bonus game by a designated quantity (such as one). If a designated quantity of the free play indicators (such as all of the free play indicators) is accumulated, the gaming system resets those accumulated free play indicators to their non-accumulated states.

It should thus be appreciated that the keno-type primary game and the keno-type bonus games of the present disclosure provide an increased level of excitement and enjoyment for certain players.

Additional features and advantages are described herein, and will be apparent from, the following Detailed Description and the Figures.

BRIEF DESCRIPTION OF THE FIGURES

FIGS. 3A and 3B are a flowchart of an example process or method of operating the gaming system to provide one example embodiment of the keno-type bonus game of the present disclosure.

FIGS. 4A, 4B, 4C, 4D, 4E, 4F, 4G, 4H, and 4I are screen shots of an example embodiment of the gaming system of the present disclosure configured to operate one example of the keno-type bonus game of the present disclosure.

DETAILED DESCRIPTION

Gaming System and Method Providing a Keno-Type Primary Game Associated with Persistence Pools that May be Incremented to Trigger One or More Bonuses Various embodiments of the present disclosure are directed to a gaming system and method providing a keno-type primary game associated with persistence pools values that may be incremented to trigger one or more bonuses.

Keno-Type Primary Game

Generally, in various embodiments, the gaming system of the present disclosure is configured to operate a keno-type primary game associated with a plurality of different incrementable persistence pools. Each persistence pool is associated with a different one of a plurality of different designated values and a different one of a plurality of different bonuses. For each persistence pool, the gaming system increments that persistence pool when a certain event associated with the corresponding designated value occurs during play of the keno-type primary game. For each persistence pool, the gaming system provides the bonus associated with that persistence pool when that persistence pool increments to a designated value. The gaming system of the present disclosure thus enables persistence pools to be incremented across a plurality of plays of the keno-type primary game and, in some instances, over a plurality of gaming sessions to attempt to trigger the bonuses.

More specifically, in various embodiments, the gaming system of the present disclosure is configured to operate a keno-type primary game associated with a plurality of different persistence pools. Each persistence pool is associated with a different one of a plurality of different designated values and one of a plurality of different keno-type bonus games (i.e., bonuses in these embodiments). The gaming system increments the persistence pools by accumulating the designated values upon the occurrence of certain events during play of the keno-type primary game. When the gaming system accumulates a designated quantity of a particular designated value (i.e., when a particular persistence pool increments to the designated quantity in these embodiments), the gaming system provides the keno-type bonus game associated with that particular designated value. In these embodiments, the gaming system of the present disclosure thus enables accumulation of designated values across a plurality of plays of the keno-type primary game and, in some instances, over a plurality of gaming sessions to attempt to trigger the keno-type bonus game(s).

Figure 1A:
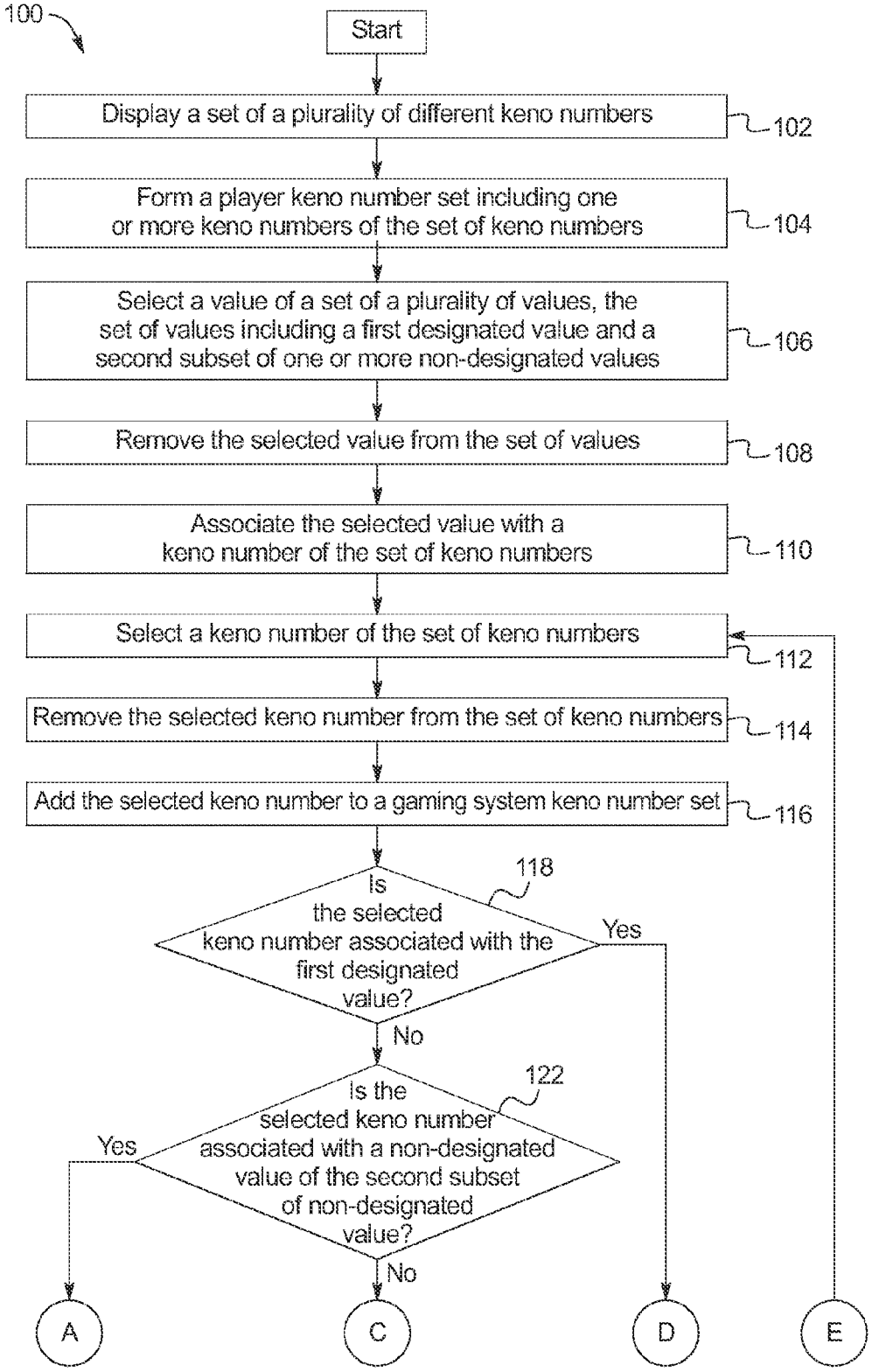
FIGS. 1A and 1B are a flowchart of an example process or method of operating the gaming system to provide one example embodiment of the keno-type primary game of the present disclosure.
Figure 1B:
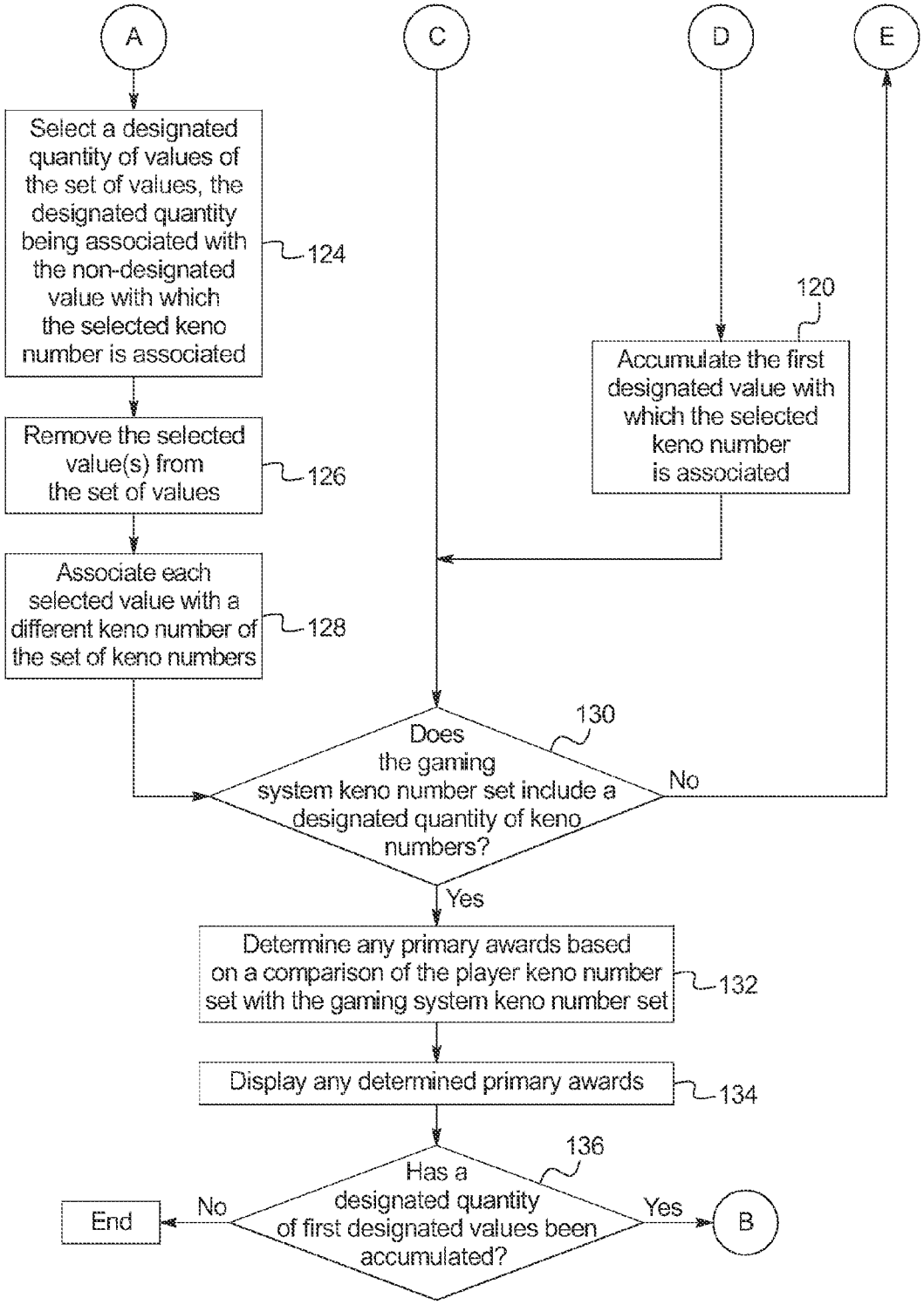

FIGS. 1A and 1B are a flowchart of an example process or method 100 of operating the gaming system to provide one example embodiment of the keno-type primary game of the present disclosure. In various embodiments, the process 100 is represented by a set of instructions stored in one or more memories and executed by one or more processors. Although the process 100 is described with reference to the flowchart shown in FIGS. 1A and 1B, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, the process 100 begins upon receipt of a wager from a player. The gaming system displays a set of a plurality of different keno numbers (such as the numbers 1 through 80), as indicated by block 102. The gaming system forms a player keno number set including one or more keno numbers of the set of keno numbers (such as two to ten of the keno numbers), as indicated by block 104. More specifically, in this embodiment, the gaming system receives, from the player, a selection of the one or more keno numbers of the set of keno numbers to include in the player keno number set or an indication that the player desires the gaming system to select the one or more keno numbers of the set of keno numbers to include in the player keno number set.

The gaming system selects a value of a set of a plurality of values (such as a set of the plurality of playing card values of the playing cards of a fifty-two card deck of playing cards), as indicated by block 106. In this embodiment, the set of values includes a first designated value and a second subset of one or more non-designated values. The gaming system removes the selected value from the set of values, as indicated by block 108. The gaming system associates the selected value with a keno number in the set of keno numbers, as indicated by block 110.

The gaming system begins forming a gaming system keno number set by selecting a keno number in the set of keno numbers, as indicated by block 112. The gaming system removes the selected keno number from the set of keno numbers, as indicated by block 114, and adds the selected keno number to the gaming system keno number set, as indicated by block 116. The gaming system determines whether the selected keno number is associated with the first designated value, as indicated by diamond 118. If the gaming system determines at diamond 118 that the selected keno number is associated with the first designated value, the gaming system accumulates the first designated value with which the selected keno number is associated, as indicated by block 120. The process 100 proceeds to diamond 130, described below.

If, on the other hand, the gaming system determines at diamond 118 that the selected keno number is not associated with the first designated value, the gaming system determines whether the selected keno number is associated with a non-designated value of the second subset of non-designated values, as indicated by diamond 122.

If the gaming system determines at diamond 122 that the selected keno number is associated with a non-designated value of the second subset of non-designated values, the gaming system selects a designated quantity of values of the set of values, as indicated by block 124. In this embodiment, the designated quantity is the non-designated value with which the selected keno number is associated. The gaming system removes the selected value(s) from the set of values, as indicated by block 126, and associates each selected value with a different keno number in the set of keno numbers, as indicated by block 128. The process 100 proceeds to diamond 130, described below.

If, on the other hand, the gaming system determines at diamond 122 that the selected keno number is not associated with a non-designated value of the second subset of non-designated values, the gaming system determines whether the gaming system keno number set includes a designated quantity of keno numbers (i.e., determines whether the gaming system has completed forming the gaming system keno number set), as indicated by diamond 130. If the gaming system determines at diamond 130 that the gaming system keno number set does not include the designated quantity of keno numbers, the process 100 returns to block 112.

If, on the other hand, the gaming system determines at diamond 130 that the gaming system keno number set includes the designated quantity of keno numbers, the gaming system determines any primary awards based on a comparison of the player keno number set with the gaming system keno number set, as indicated by block 132. The gaming system displays any determined primary awards, as indicated by block 134. The gaming system determines whether a designated quantity of first designated values has been accumulated, as indicated by diamond 136. If the gaming system determines at diamond 136 that the designated quantity of first designated values has not been accumulated, the process 100 ends. If, on the other hand, the gaming system determines at diamond 136 that the designated quantity of first designated values has been accumulated, the gaming system provides a bonus game and executes process 300, described below.

While the process 100 described in association with FIG. 1 includes one accumulatable designated value and associated bonus game, it should be appreciated that the present disclosure contemplates a plurality of different accumulatable designated values and associated different bonus games.

FIGS. 2A, 2B, 2C, 2D, 2E, and 2F are screen shots of an example embodiment of the gaming system of the present disclosure configured to operate one such example of the keno-type primary game of the present disclosure. In this example embodiment, the keno-type primary game is associated with four different persistence pools associated with four different keno-type bonus games: (1) a King persistence pool associated with a King Bonus, (2) a Queen persistence pool associated with a Queen Bonus, (3) a Jack persistence pool associated with a Jack Bonus, and (4) an Ace persistence pool associated with an Ace Bonus. Operation of the keno-type bonus games are described in detail below with respect to FIGS. 3A to 4I.

Generally, in this example embodiment, the Bonuses have different average expected payback percentages and different probabilities of being triggered, and the average expected payback percentages and the probabilities of being triggered are inversely related. Specifically, in this example embodiment: (1) the King Bonus has the highest average expected payback percentage and the lowest probability of being triggered, (2) the Queen Bonus has the second highest average expected payback percentage and the second lowest probability of being triggered, (3) the Jack Bonus has the second lowest average expected payback percentage and the second highest probability of being triggered, and (4) the Ace Bonus has the lowest average expected payback percentage and the highest probability of being triggered. It should be appreciated that such relative probabilities of occurring may change depending on the quantity of accumulated designated values required to trigger with the Bonuses.

In this example embodiment: (1) the keno-type primary game is associated with a set of keno numbers including the numbers 1 through 80 (though it should be appreciated that the keno-type primary game may be associated with any suitable numbers or range of numbers and/or any suitable symbols (such as letters, characters, themed images, and the like) instead of or in addition to numbers); and (2) the plurality of values include the playing card values of the plurality of different playing cards of a standard deck of a set of fifty-two playing cards (i.e., four Two playing card values, four Three playing card values, four Four playing card values, four Five playing card values, four Six playing card values, four Seven playing card values, four Eight playing card values, four Nine playing card values, four Ten playing card values, four Jack playing card values, four Queen playing card values, four King playing card values, and four Ace playing card values).

In this example embodiment: (1) the subset of non-designated values includes the Two, Three, Four, Five, Six, Seven, Eight, Nine, and Ten playing card values (referred to herein as the Two, Three, Four, Five, Six, Seven, Eight, Nine, and Ten non-designated values); and (2) the subset of designated values includes the King, Queen, Jack, and Ace playing card values (referred to herein as the King, Queen, Jack, and Ace designated values). Here: (1) the King persistence pool (and the King Bonus) is associated with the King designated value, (2) the Queen persistence pool (and the Queen Bonus) is associated with the Queen designated value, (3) the Jack persistence pool (and the Jack Bonus) is associated with the Jack designated value, and (4) the Ace persistence pool (and the Ace Bonus) is associated with the Ace designated value. As described in detail below, during a play of the keno-type primary game, the gaming system increments the King, Queen, Jack, and Ace persistence pools by accumulating a King, Queen, Jack, and/or Ace designated value if the gaming system selects a keno number that is associated with one of the King, Queen, Jack, and/or Ace designated values to include in the gaming system keno number set (i.e., when a particular triggering event occurs).

In this example embodiment, the King, Queen, Jack, and Ace persistence pools are associated with different designated quantities of designated values required to be accumulated (i.e., different designated increment values) to trigger the corresponding Bonus. More specifically: (1) the King persistence pool is associated with a designated quantity of ten King designated values to be accumulated to trigger the King Bonus, (2) the Queen persistence pool is associated with a designated quantity of six Queen designated values required to be accumulated to trigger the Queen Bonus, (3) the Jack persistence pool is associated with a designated quantity of three Jack designated values required to be accumulated to trigger the Jack Bonus, and (4) the Ace persistence pool is associated with a designated quantity of one Ace designated value required to be accumulated to trigger the Ace Bonus.

In this example embodiment, the gaming system displays (such as on a display device 1116 or 1118, described below) a grid 200 that includes a plurality of keno number positions (not labeled for clarity). The gaming system displays a different one of the keno numbers of the set of keno numbers 1 through 80 at each of the keno number positions.

In this example embodiment, the gaming system also displays four designated value accumulation areas, each of which is associated with a different one of the King, Queen, Jack, and Ace Bonuses. Specifically, the gaming system displays: (1) a King designated value accumulation area 230 associated with the King Bonus, (2) a Queen designated value accumulation area 240 associated with the Queen Bonus, (3) a Jack designated value accumulation area 250 associated with the Jack bonus, and (4) an Ace designated value accumulation area 260 associated with the Ace bonus. Each designated value accumulation area includes a quantity of one or more designated value display areas (not labeled for clarity) configured to display a corresponding accumulated designated value. Specifically, in this example embodiment, the quantity of designated value display areas of a particular designated value accumulation area is equal to the designated quantity of designated values required to be accumulated to trigger the Bonus corresponding to that particular designated value accumulation area. That is: (1) the King designated value accumulation area 230 includes ten King designated value display areas, (2) the Queen designated value accumulation area 240 includes six Queen designated value display areas, (3) the Jack designated value accumulation area 250 includes three Jack designated value accumulation areas, and (4) the Ace designated value accumulation area 260 includes one Ace designated value accumulation area.

In this example embodiment, the gaming system also displays a paytable 270 that indicates a plurality of quantities of "Hits" and a corresponding award amount for each "Hit". A "Hit" occurs when the gaming system selects a keno number to include in the gaming system keno number set that is also included in the player keno number set, as described below. In this example embodiment, the quantity of "Hits" included in the paytable 270 and the corresponding award amounts are determined based on a player keno number set including ten keno numbers and a bet of 8 credits. It should be appreciated that both the quantity of "Hits" and the corresponding award amounts included in the paytable 270 may vary when the player keno number set includes fewer than or more than ten keno numbers and/or when the bet is greater than or less than 8 credits.

The gaming system also displays: (a) a plurality of meters including: (i) an award meter 282 that displays any awards won for a play of the keno-type primary game (in credit or currency form); (ii) a bet meter 284 that displays any bet placed on a play of the keno-type primary game (in credit or currency form), and (iii) a credit meter 286 that displays the credit balance of the player (in credit or currency form); and (b) a plurality of buttons actuatable by the player including: (i) a Start button 292 that, when actuated by the player, causes the gaming system to initiate a play of the keno-type primary game; (ii) a Clear button 294 that, when actuated by the player, causes the gaming system to remove any keno numbers from the player keno number set; (iii) a Quick Pick button 296 that, when actuated by the player, causes the gaming system to randomly determine which keno numbers to include in the player keno number set; and (iv) increase and decrease bet buttons (not labeled) included in the bet meter 284 that, when actuated by the player, respectively increase and decrease the quantity of credits or currency displayed by the bet meter 284.

Figure 2A:
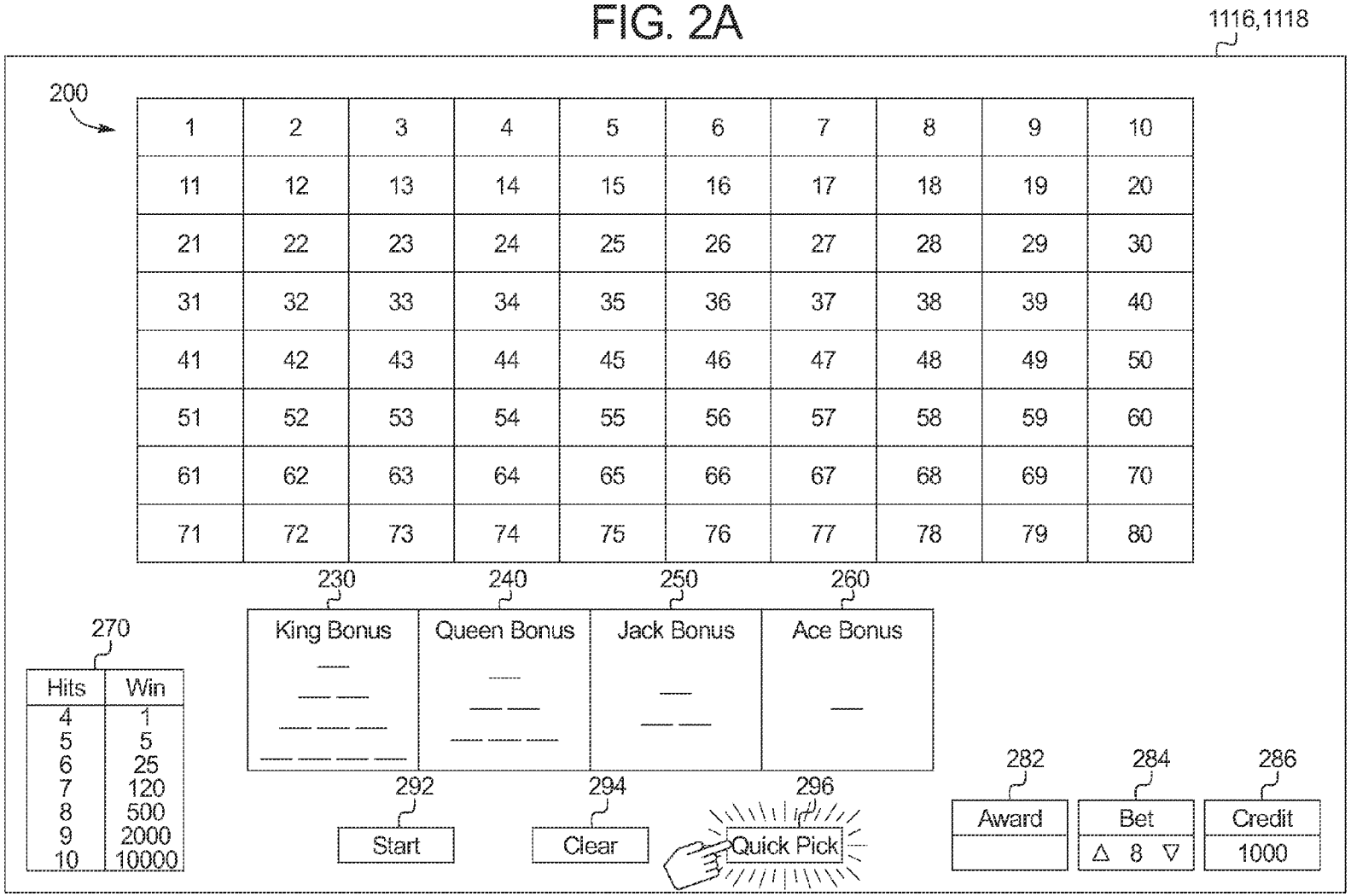
FIGS. 2A, 2B, 2C, 2D, 2E, and 2F are screen shots of an example embodiment of the gaming system of the present disclosure configured to operate one example of the keno-type primary game of the present disclosure.

Turning to FIG. 2A, the gaming system receives a deposit of value from the player and provides the player with 1,000 credits, as shown in the credit meter 286. The gaming system displays a desired bet of 8 credits in the bet meter 284, and enables the player to modify the desired bet using the increase and/or decrease bet buttons. The gaming system enables the player to select which of the keno numbers to include in the player keno number set. More specifically, in this example embodiment, the gaming system enables the player to: (1) manually select between two and ten of the keno numbers to include in the player keno number set (such as via a touch screen or a dedicated button or buttons, described below), or (2) actuate the Quick Pick button 296 to cause the gaming system to randomly select ten of the keno numbers to include in the player keno number set. Here, the gaming system receives an actuation of the Quick Pick button 296.

Figure 2B:
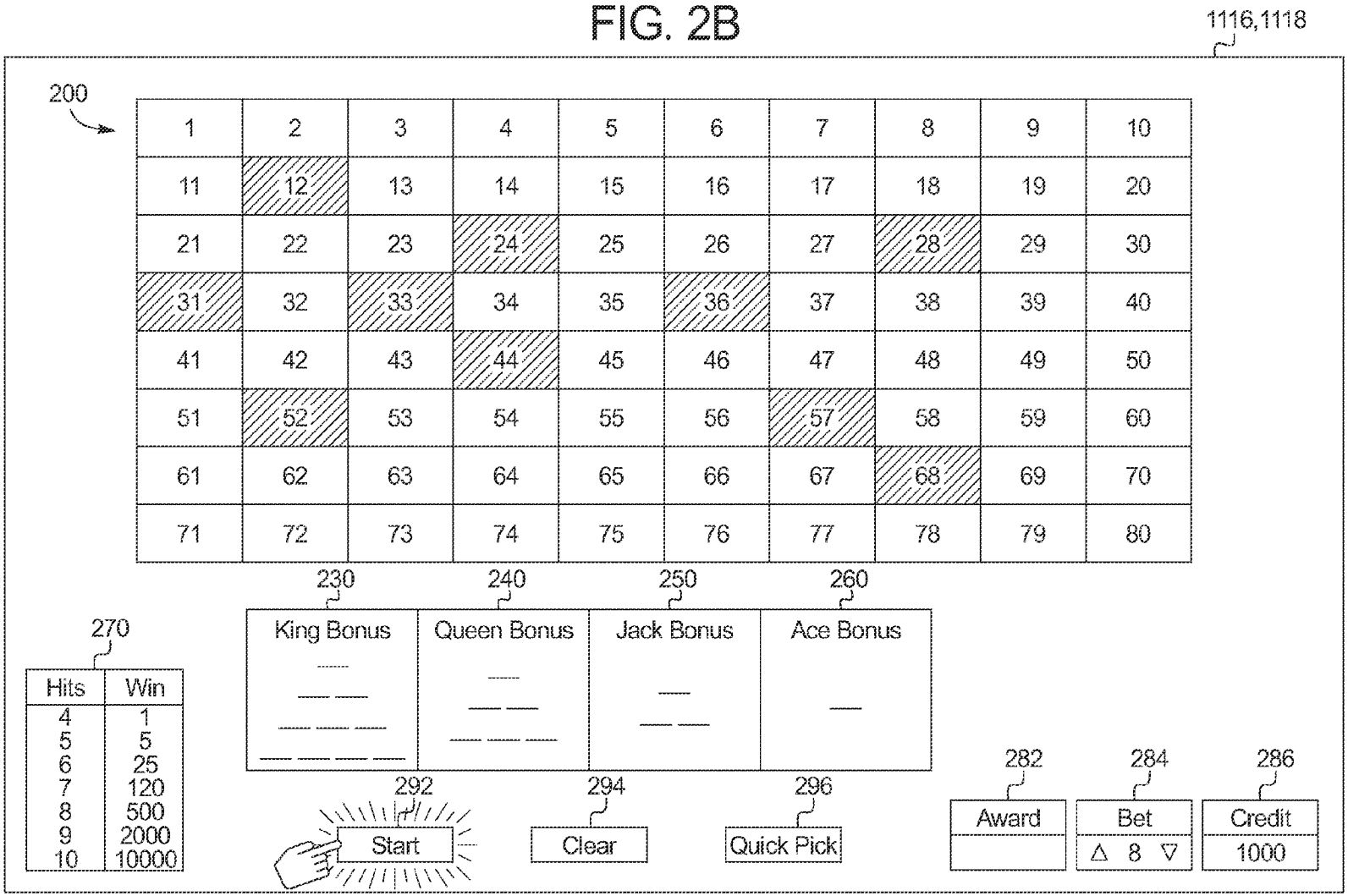

As shown in FIG. 2B, upon receiving the actuation of the Quick Pick button 296, the gaming system randomly selects the keno numbers 12, 24, 28, 31, 33, 36, 44, 52, 57, and 68 to include in the player keno number set. In this example embodiment, the gaming system displays a hatch pattern each of the keno number positions corresponding to the keno numbers of the player keno number set for clarity, though it should be appreciated that the gaming system may indicate the keno numbers of the player keno number set in any suitable manner, such as by shading each of the corresponding keno number positions, coloring each of the corresponding keno number positions, displaying an icon in each of the corresponding keno number positions, changing the typeface used for the corresponding keno number positions, and the like. After the gaming system forms the player keno number set, the gaming system receives an actuation of the Start button 292 from the player.

Figure 2C:
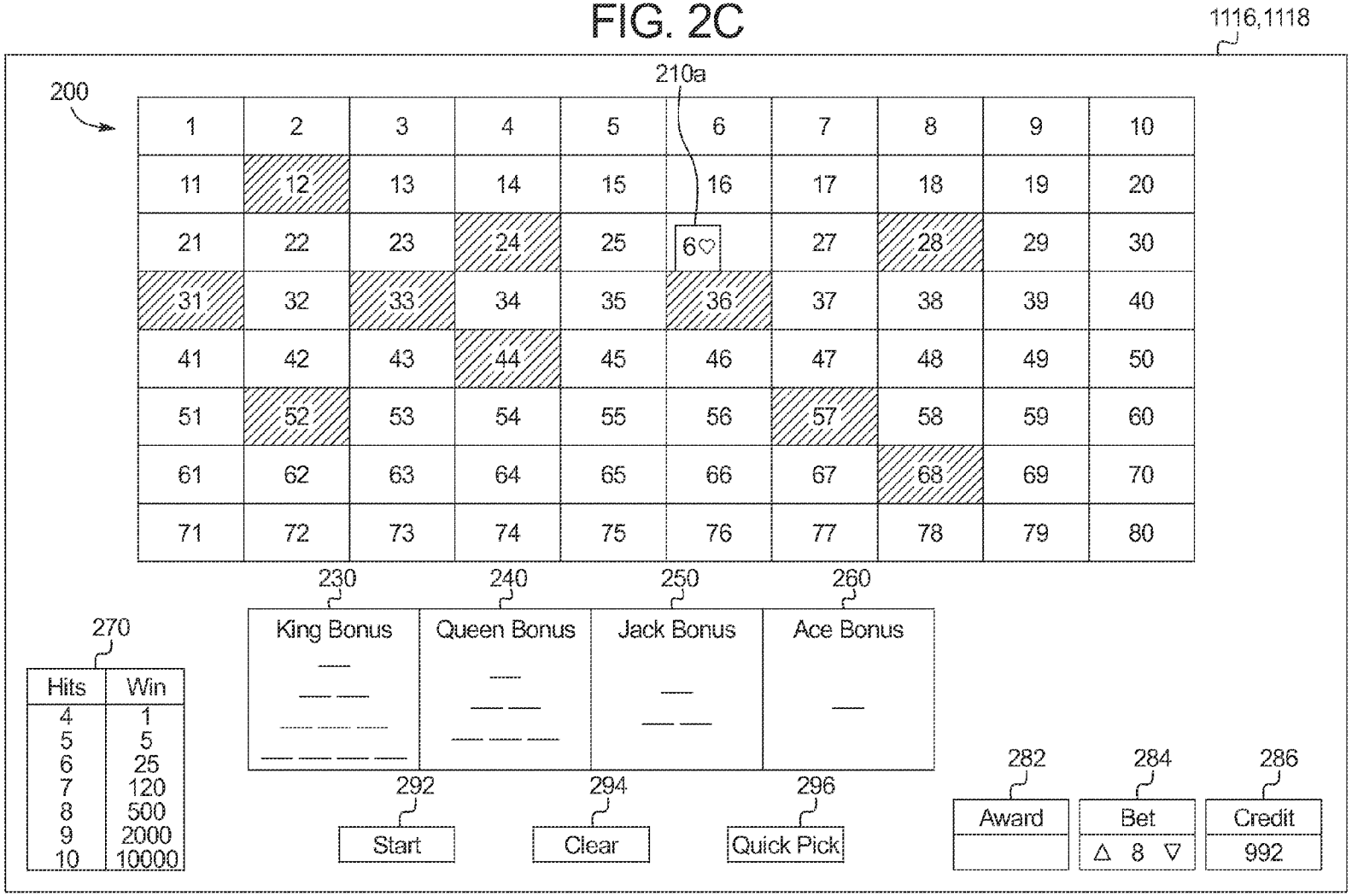

As shown in FIG. 2C, upon receipt of the actuation of the Start button 292, the gaming system: (1) reduces the credit balance of the player by the desired 8 credit bet (from 1,000 credits to 992 credits, as shown in the credit meter 286); (2) selects one of the plurality of playing cards and removes the selected playing card from the set of playing cards; (3) selects one of the keno numbers not included in the player keno number set and not already associated with a value; and (4) displays an indicator representing the selected playing card at the keno number position of the selected keno number. In this example embodiment, the gaming system selects the 6♥ (which has the Six non-designated value) and the keno number 26, and displays an indicator 210*a* representing the 6♥ at the keno number position of the keno number 26. It should be appreciated that the gaming system may initially select any suitable quantity of the playing cards (i.e., the values) to associate with the keno numbers before forming the gaming system keno number set.

Figure 2D:
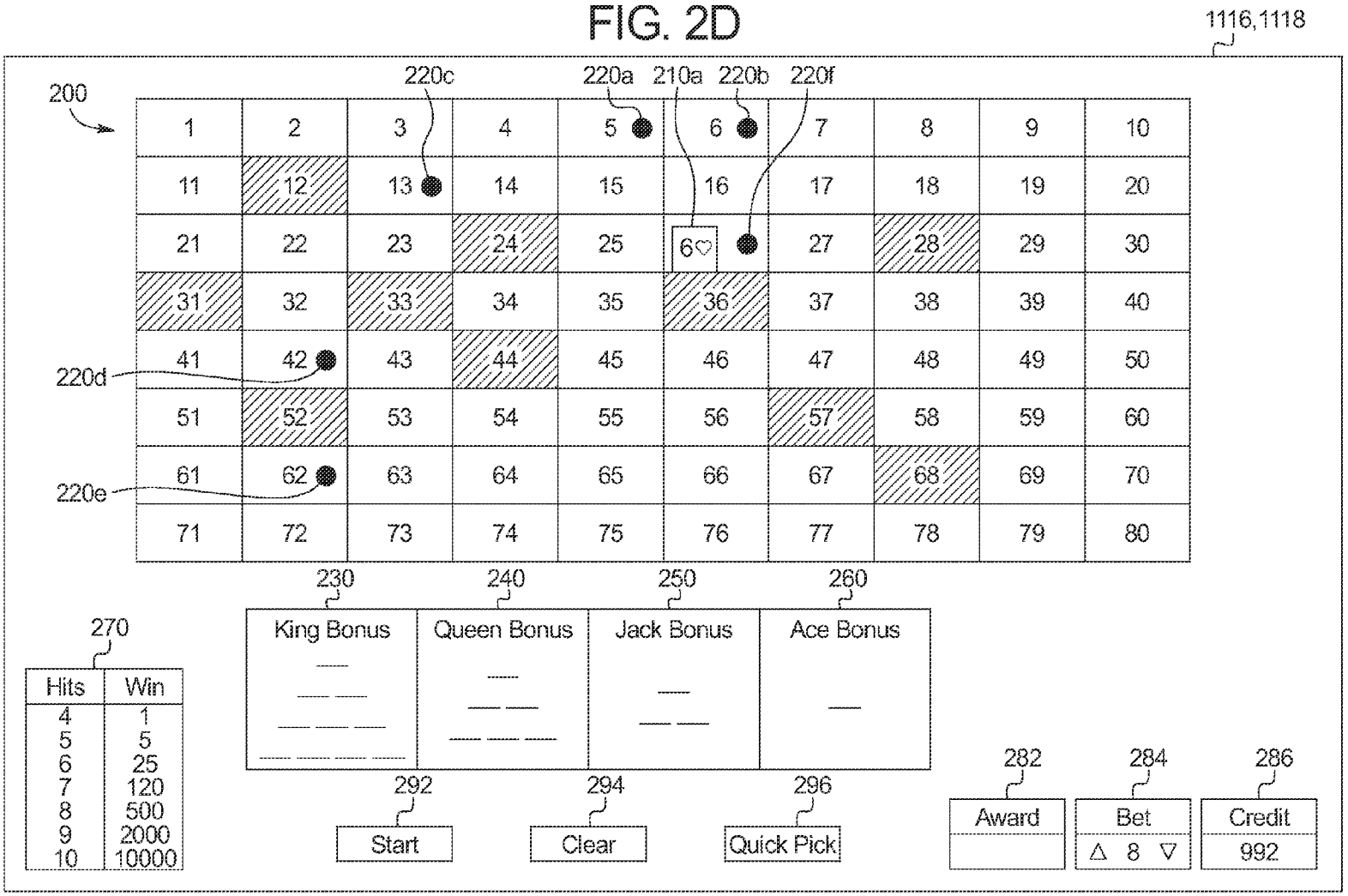

As shown in FIG. 2D, after selecting the 6♥ and associating the 6♥ with the keno number 26, the gaming system begins sequentially selecting the twenty keno numbers to include in the gaming system keno number set. At this point, the gaming system has previously selected the keno numbers 5, 6, 13, 42, and 62 to include in the gaming system keno number set and has most recently selected the keno number 26, which is associated with the 6♥ (i.e., the Six non-designated value), to include in the gaming system keno number set. In this example embodiment, the gaming system displays an indicator (such as a ball icon) in the keno number position of each keno number included in the gaming system keno number set, though it should be appreciated that the gaming system may indicate the keno numbers included in the gaming system keno number set in any suitable manner. Here, the gaming system displays an indicator 220*a* in the keno number position of the keno number 5, an indicator 220*b* in the keno number position of the keno number 6, an indicator 220*c* in the keno number position of the keno number 13, an indicator 220*f* in the keno number position of the keno number 26, an indicator 220*d* in the keno number position of the keno number 42, and an indicator 220*e* in the keno number position associated with the keno number 62.

In this example embodiment, when the gaming system selects a keno number associated with a non-designated value to include in the gaming system keno number set, the gaming system: (1) adds that selected keno number to the gaming system keno number set; (2) temporarily suspends the selection of keno numbers to include in the gaming system keno number set (should any further selection be necessary); (3) selects a designated quantity of the remaining playing cards of the set of playing cards and removes that(those) playing card(s) from the set of playing cards; (4) for each selected playing card, selects one of the keno number not included in the player keno number set, not already associated with a playing card, and not already included in the gaming system keno number set and displays an indicator representing that selected playing card at the keno number position of the selected keno number; and (5) resumes selection of keno numbers to include in the gaming system keno number set (should any further selection be necessary). In this example embodiment, each non-designated value is associated with a designated quantity equal to that non-designated value's numeric value (e.g., the Two non-designated value is associated with a designated quantity of two, the Three non-designated value is associated with a designated quantity of three, etc.). It should be appreciated that each non-designated value may be associated with any suitable designated quantity.

Figure 2E:
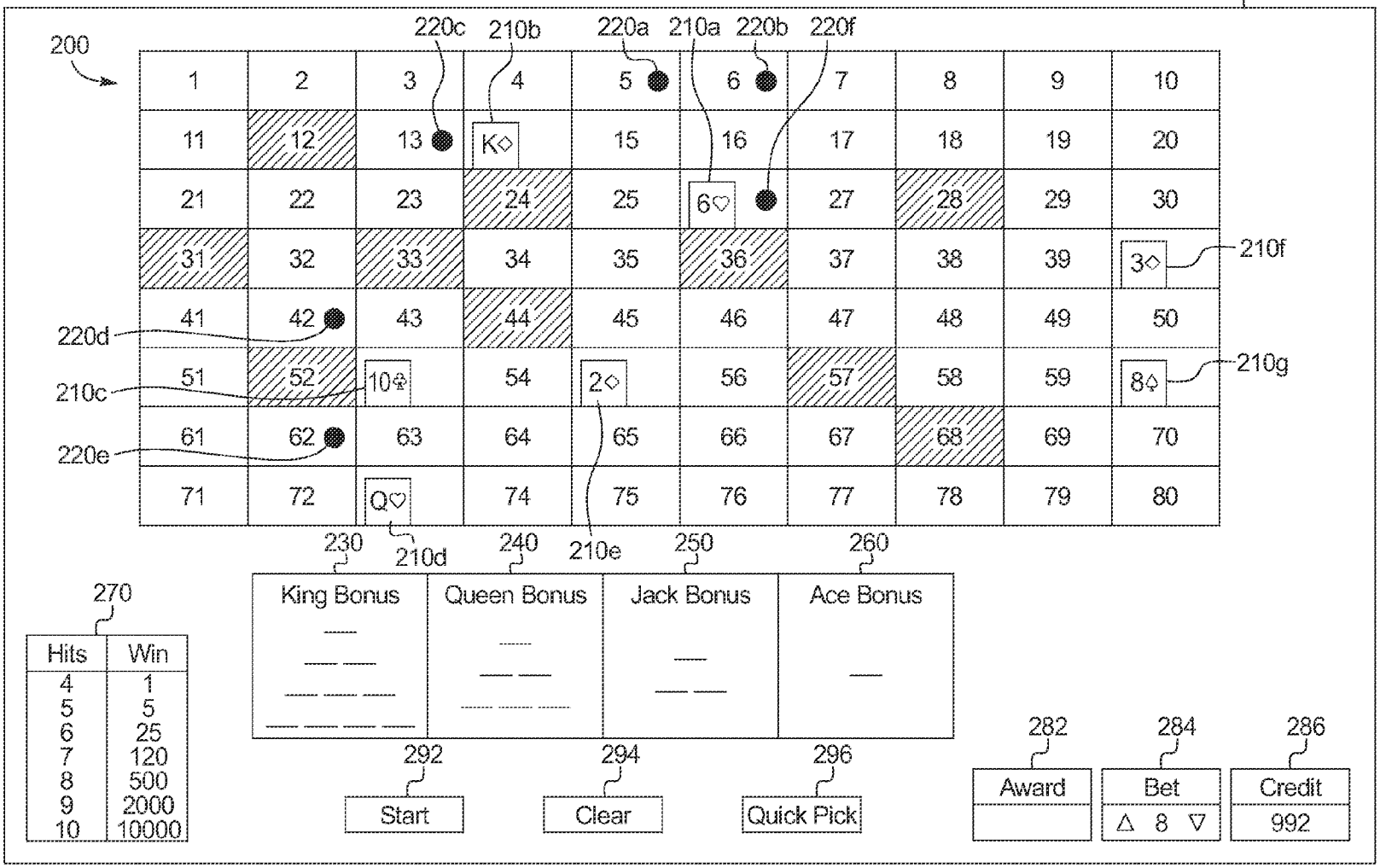

As shown in FIG. 2E, because the gaming system selected the keno number 26 associated with the Six non-designated value, the gaming system: (1) adds the keno number 26 to the gaming system keno number set; (2) temporarily suspends the selection of the remaining fourteen keno numbers to include in the gaming system keno number set; (3) selects the following six playing cards from the remaining playing cards of the set of playing cards and removes these playing cards from the set of playing cards: K♦, 3♦, 10♣, 2♦, 8♠, and Q♥; (4) randomly associates the K♦ with the keno number 5 and displays an indicator 210*b* representing the K♦ at the keno number position of the keno number 5, randomly associates the 3♦ with the keno number 40 and displays an indicator 210*f* representing the 3♦ at the keno number position of the keno number 40, randomly associates the 10♣ with the keno number 53 and displays an indicator 210*c* representing the 10♣ at the keno number position of the keno number 53, randomly associates the 2♦ with the keno number 55 and displays an indicator 210*e* representing the 2♦ at the keno number position of the keno number 55, randomly associates the 8♠ with the keno number 60 and displays an indicator 210*g* representing the 8♠ at the keno number position of the keno number 60, and randomly associates the Q♥ with the keno number 73 and displays an indicator 210*d* representing the Q♥ at the keno number position of the keno number 73; and (5) resumes selection of the remaining fourteen keno numbers to include in the gaming system keno number set.

Figure 2F:
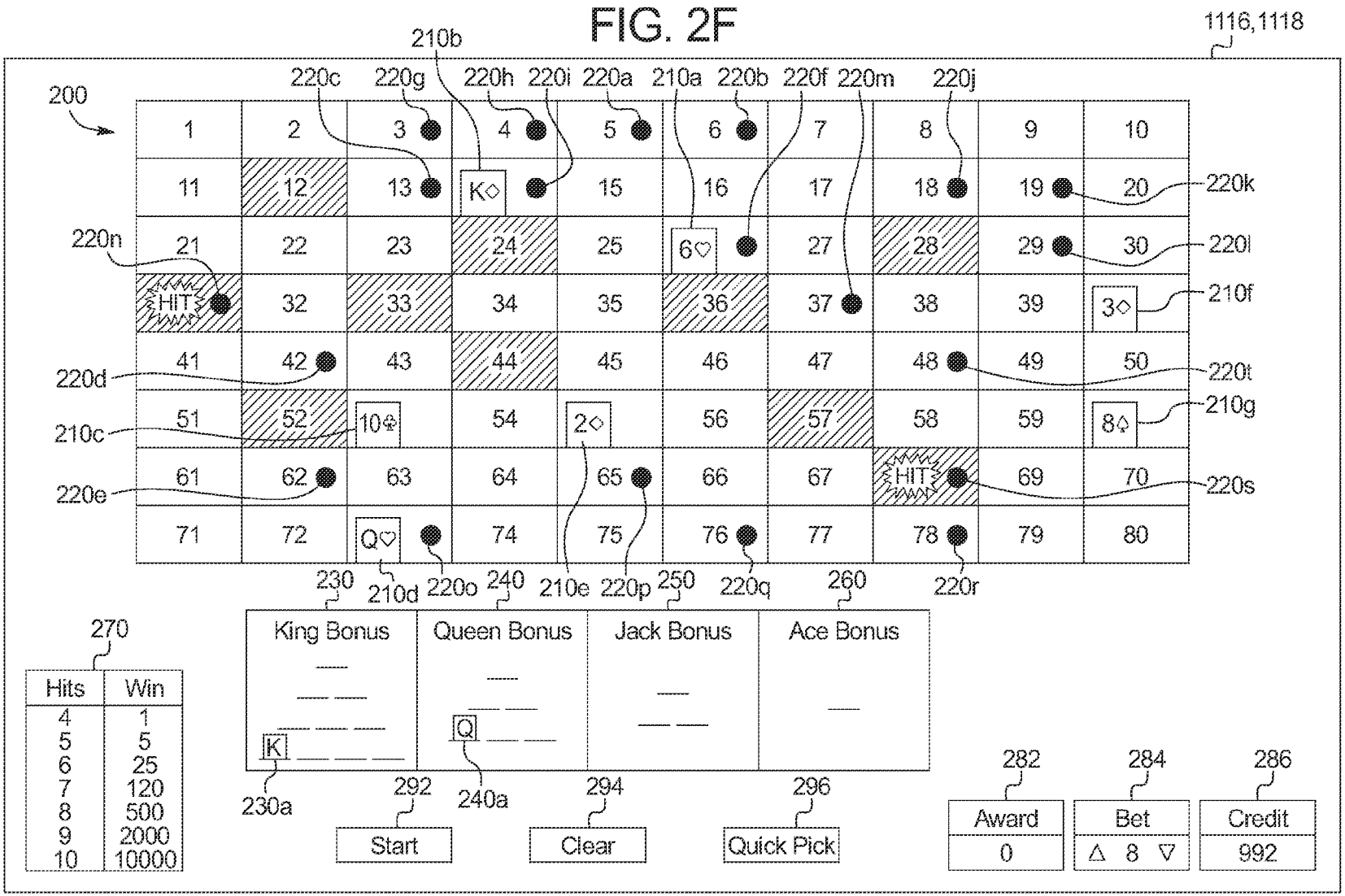

As shown in FIG. 2F, the gaming system has completed the gaming system keno number set by selecting fourteen additional keno numbers 3, 4, 14, 18, 19, 29, 31, 37, 48, 65, 68, 73, 76, and 78 to include in the gaming system keno number set. The gaming system displays an indicator 220*g* in the keno number position of the keno number 3, an indicator 220*h* in the keno number position of the keno number 4, an indicator 220*i* in the keno number position of the keno number 14, an indicator 220*j* in the keno number position of the keno number 18, an indicator 220*k* in the keno number position of the keno number 19, an indicator 220*l* in the keno number position associated with the keno number 29, an indicator 220*n* in the keno number position associated with the keno number 31, an indicator 220*m* in the keno number position associated with the keno number 37, an indicator 220*t* in the keno number position associated with the keno number 48, an indicator 220*p* in the keno number position associated with the keno number 65, an indicator 220*s* in the keno number position associated with the keno number 68, an indicator 220*o* in the keno number position associated with the keno number 73, an indicator 220*q* in the keno number position associated with the keno number 76, and an indicator 220*r* in the keno number position associated with the keno number 78.

None of these additional fourteen selected keno numbers is associated with a non-designated value. Two of these selected keno numbers are associated with designated values. Specifically, the keno number 14 is associated with the K♦ (i.e., the King designated value) and the keno number 73 is associated with the Q♥ (i.e., the Queen designated value). In this example embodiment, when the gaming system selects a keno number associated with a designated value to include in the gaming system keno number set, the gaming system: (1) adds that selected keno number to the gaming system keno number set, and (2) accumulates that designated value (to increment the associated persistence pool) by displaying an indicator associated with that designated value at an unoccupied designated value display area of the designated value accumulation area associated with that designated value. It should be appreciated that the gaming system may indicate the accumulation of a designated value (i.e., the incrementing of a persistence pool in this embodiment) in any suitable manner.

Here, because the gaming system selected the keno number 14 associated with the King designated value, the gaming system: (1) adds the keno number 14 to the gaming system keno number set, and (2) accumulates the King designated value (i.e., increments the King persistence pool) by displaying an indicator 230*a* at an unoccupied King designated value display area of the King designated value accumulation area 230. Similarly, because the gaming system selected the keno number 73 associated with the Queen designated value, the gaming system: (1) adds the keno number 73 to the gaming system keno number set, and (2) accumulates the Queen designated value (i.e., increments the Queen persistence pool) by displaying an indicator 240*a* at an unoccupied Queen designated value display area of the Queen designated value accumulation area 240.

The gaming system makes an award determination for the play of the keno-type primary game by determining how many "Hits" occurred. As noted above, a "Hit" occurs when a keno number in the gaming system keno number set is also included in the player keno number set. In this instance, two "Hits" occurred because the keno numbers 31 and 68 are each included in both the player keno number set and the gaming system keno number set. The gaming system indicates when a "Hit" occurs by displaying a "Hit" indicator (not labeled for clarity) in the keno number position of each keno number included in both the player keno number set and the gaming system keno number set, though it should be appreciated that the gaming system may indicate "Hits" in any suitable manner. The gaming system determines based on the paytable 270 that a quantity of two "Hits" is not associated with any award amount and, therefore, does not provide any award for the play of the keno-type primary game.

The gaming system determines, for each of the Bonuses, whether the designated quantity of designated values associated with the particular Bonus has been accumulated (i.e., whether the corresponding persistence pool has been incremented to its corresponding designated value). Specifically, in this example embodiment, the gaming system determines that: (1) the designated quantity of ten King designated values has not been accumulated (i.e., the King persistence pool has not yet been incremented to its corresponding designated value), (2) the designated quantity of six Queen designated values has not been accumulated (i.e., the Queen persistence pool has not yet been incremented to its corresponding designated value), (3) the designated quantity of three Jack designated values has not been accumulated (i.e., the Jack persistence pool has not yet been incremented to its corresponding designated value), and (4) the designated quantity of one Ace designated value has not been accumulated (i.e., the Ace persistence pool has not yet been incremented to its corresponding designated value). Accordingly, the gaming system does not provide any of the King, Queen, Jack, or Ace Bonuses.

The persistence pools may be associated with any suitable type of bonuses other than the keno-type bonus games described herein such as, but not limited to: (1) progressive awards (e.g., a King progressive award (which is the largest progressive award), a Queen progressive award (which is the second largest progressive award), a Jack progressive award (which is the second smallest progressive award), and an Ace progressive award which is the smallest progressive award)); (2) free spins (e.g., a King free spins bonus including a highest quantity of free spins, a Queen free spins bonus including a second highest quantity of free spins, a Jack bonus including a second lowest quantity of free spins, and an Ace bonus including a lowest quantity of free spins);

(3) wheel spins (e.g., a King wheel spin including a most valuable wheel, a Queen wheel spin including a second most valuable wheel, a Jack wheel spin including a second least valuable wheel, and an Ace wheel spin including a least valuable wheel); (4) selection games (e.g., a King selection game including a most valuable award set, a Queen selection game including a second most valuable award set, a Jack selection game including a second least valuable award set, and an Ace selection game including a least valuable award set); (5) credit awards or other suitable monetary or non-monetary awards (e.g., a King award of 10,000 credits, a Queen award of 5,000 credits, a Jack award of 1,000 credits, and an Ace award of 500 credits); (6) modifiers (such as multipliers) used to modify one or more awards (such as any award for the play of the keno-type primary game); (7) free plays of a game; (8) free plays of one or more bonus games; (9) lottery based awards (such as one or more lottery or drawing tickets); (10) wager matches for one or more plays of a wagering game; (11) increases in the average expected payback percentage of a bonus game and/or the average expected payback percentage of a primary wagering game for one or more plays; (12) comps (such as a free dinner or a free night's stay at a hotel); (13) bonus or promotional credits usable for online play; (14) player tracking points; (15) modifiers (such as multipliers) for player tracking points or credits; (16) increases in a membership or player tracking level; (17) coupons or promotions usable within a gaming establishment and/or outside of the gaming establishment (e.g., a 20% off coupon for use at a retail store or a promotional code providing a deposit match for use in association with an online casino); (18) access codes usable to unlock content; (19) high value products or services (such as cars); (20) low value products or services (such as teddy bears); and/or (21) primary game or bonus game retriggers.

In certain embodiments, different persistence pools are associated with different types of bonuses. For instance, in one example embodiment, one persistence pool is associated with a free spin bonus game while another persistence pool is associated with an award of credits.

The accumulatable designated values may be any suitable elements other than the playing card values described above such as, but not limited to: (1) colors, (2) patterns, (3) playing card suits, (4) indicia (such as sports teams' logos or college logos), (5) themes, (6) numbers, (7) letters, and/or (8) words.

In certain embodiments, a plurality of different designated values are associated with the same persistence pool. For instance, in one example embodiment, the primary keno-type game is associated with a first persistence pool and a second different persistence pool. In this example embodiment, first and second different designated values are associated with (and accumulatable in association with) the first persistence pool, and third and fourth different designated values are associated with (and accumulatable in association with) the second persistence pool.

In various embodiments, the gaming system may associate a plurality of values with a particular keno number during a play of the keno-type primary game. For instance, the gaming system may associate a first value with keno number 23 at a first point time during the play of the keno-type primary game and a second different value with keno number 23 at a second subsequent point in time during the play of the keno-type primary game.

In certain embodiments, the gaming system may associate one or more values with one or more keno numbers in the player number set. For instance, in one example embodiment in which the keno number 19 is in the player number set, the gaming system randomly selects and associates a value with the keno number 19. In one such embodiment, if the gaming system associates a designated value with a keno number included in the player number set, the gaming system accumulates that designated value by displaying an indicator associated with that designated value at an unoccupied designated value display area of the designated value accumulation area associated with that designated value. In one such embodiment, if the gaming system associates a non-designated value with a keno number included in the player number set, the gaming system: (1) temporarily suspends the selection of keno numbers to include in the gaming system keno number set (should any further selection be necessary); (2) selects a designated quantity of the values of the set of values and removes that(those) value(s) from the set of values; (3) for each selected value, selects one of the keno numbers not included in the player keno number set, not already associated with a value, and not already included in the gaming system keno number set and displays an indicator representing that selected value at the keno number position of the selected keno number; and (4) resumes selection of keno numbers to include in the gaming system keno number set (should any further selection be necessary). In another such embodiment, if the gaming system associates a designated value with a keno number included in the player number set, the gaming system accumulates that designated value if the gaming system keno number set also includes that keno number. In another such embodiment, if the gaming system associates a non-designated value with a keno number included in the player number set and the gaming system keno number set also includes that keno number, the gaming system: (1) temporarily suspends the selection of keno numbers to include in the gaming system keno number set (should any further selection be necessary); (2) selects a designated quantity of the values of the set of values and removes that(those) value(s) from the set of values; (3) for each selected value, selects one of the keno numbers not included in the player keno number set, not already associated with a value, and not already included in the gaming system keno number set and displays an indicator representing that selected value at the keno number position of the selected keno number; and (4) resumes selection of keno numbers to include in the gaming system keno number set (should any further selection be necessary).

In other embodiments, the gaming system may associate one or more values with one or more keno numbers already included in the gaming system number set. In these embodiments, if the gaming system associates a designated value with a keno number already included in the gaming system number set, the gaming system accumulates that designated value by displaying an indicator associated with that designated value at an unoccupied designated value display area of the designated value accumulation area associated with that designated value. Additionally, in these embodiments, if the gaming system associates a non-designated value with a keno number already included in the gaming system number set, the gaming system: (1) temporarily suspends the selection of keno numbers to include in the gaming system keno number set (should any further selection be necessary); (2) selects a designated quantity of the values of the set of values and removes that(those) value(s) from the set of values; (3) for each selected value, selects one of the keno numbers not included in the player keno number set, not already associated with a value, and not already included in the gaming system keno number set and displays an indicator representing that selected value at the keno number position of the selected keno number; and (4) resumes selection of keno numbers to include in the gaming system keno number set (should any further selection be necessary).

In certain embodiments, the keno-type primary game is a persistence game in which the increment levels of the persistence pools (e.g., any accumulated designated values) persist from play to play, regardless of which particular player is playing at any point in time. In one such example embodiment, if a first player plays the keno-type primary game and accumulates eight of the ten King designated values required to trigger the King Bonus and subsequently stops playing the keno-type primary game, cashes out of the gaming system, and leaves the casino, those eight King designated values remain accumulated.

In other embodiments, the keno-type primary game is a personal persistence game in which the increment levels of the persistence pools (e.g., any designated values accumulated by a particular player) remain associated with that particular player from play to play and gaming session to gaming session. In one such example embodiment, if a first player plays the keno-type primary game and accumulates eight of the ten King designated values required to trigger the King Bonus and subsequently stops playing the keno-type primary game, cashes out of the gaming system, and leaves the casino, those eight King designated values remain accumulated for that particular player the next time the player plays the keno-type primary game.

In certain embodiments, the gaming system does not remove a value from the set of values when the gaming system associates a value with a keno number. In other words, in these embodiments, the values are selected with replacement rather than without replacement as described above with respect to FIGS. 1A to 2F.

In various embodiments, the set of values does not include any non-designated values. That is, in these embodiments, the set of values includes only designated values.

It should be appreciated that:

(a) the quantity of bonuses;
(b) the type of bonuses;
(c) the particular bonuses associated with particular designated values;
(d) the type of values;
(e) the particular non-designated values and designated values;
(f) the designated quantity of designated values to be accumulated to trigger a particular bonus;
(g) the quantity of keno numbers in the player keno number set;
(h) the particular keno numbers in the player keno number set;
(i) the quantity of keno numbers in the gaming system keno number set;
(j) the particular keno numbers in the gaming system keno number set;
(k) the designated quantities associated with the non-designated values;
(l) the particular selected value;
(m) the keno number with which a particular selected value is associated;
(n) the probabilities of triggering the bonuses;
(o) the average expected payback percentages of the bonuses;
(p) the designated event that causes a persistence pool to increment;
(q) how much a persistence pool increments; and/or
(r) any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Keno-Type Bonus Games

Figure 3B:
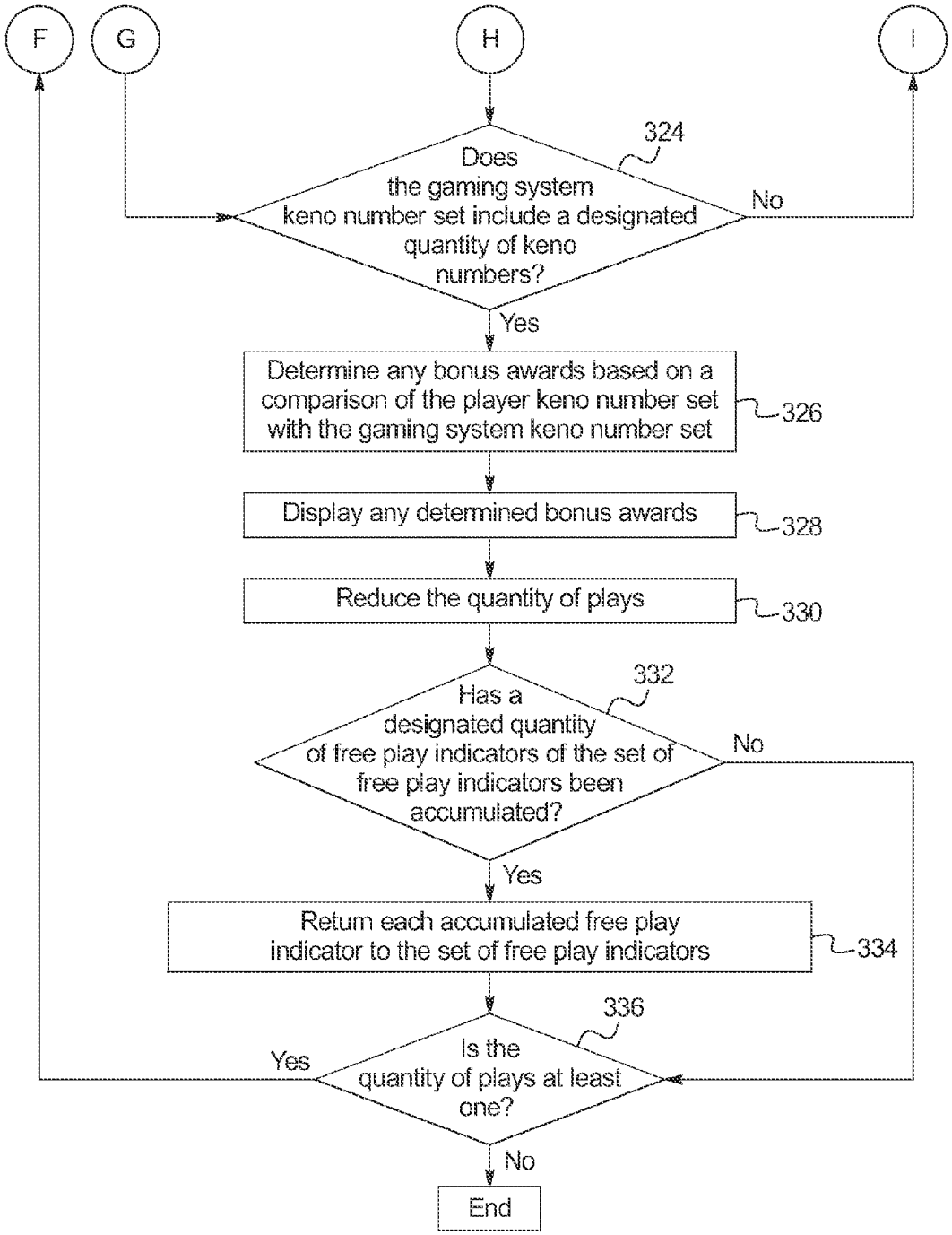

FIGS. 3A and 3B are a flowchart of an example process or method 300 of operating the gaming system to provide one example embodiment of the keno-type bonus game of the present disclosure. In various embodiments, the process 300 is represented by a set of instructions stored in one or more memories and executed by one or more processors. Although the process 300 is described with reference to the flowchart shown in FIGS. 3A and 3B, it should be appreciated that many other processes of performing the acts associated with this illustrated process 300 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, if the gaming system determines at diamond 136 of FIG. 1B (described above) that the designated quantity of first designated values has been accumulated, the gaming system initiates a bonus game including a quantity of one or more plays, as indicated by block 302. The gaming system displays the set of the plurality of different keno numbers, as indicated by block 304. The gaming system forms a player keno number set including one or more keno numbers of the set of keno numbers in one of the manners described herein, as indicated by block 306.

The gaming system associates each free play indicator of a set of one or more free play indicators with a different keno number in the set of keno numbers, as indicated by block 308. The gaming system begins forming a gaming system keno number set by selecting a keno number in the set of keno numbers, as indicated by block 310. The gaming system removes the selected keno number from the set of keno numbers, as indicated by block 312, and adds the selected keno number to the gaming system keno number set, as indicated by block 314. The gaming system determines whether the selected keno number is associated with a free play indicator of the set of free play indicators, as indicated by diamond 316. If the gaming system determines at diamond 316 that the selected keno number is not associated with a free play indicator of the set of free play indicators, the process 300 proceeds to diamond 324, described below.

If, on the other hand, the gaming system determines at diamond 316 that the selected keno number is associated with a free play indicator of the set of free play indicators, the gaming system accumulates the free play indicator with which the selected keno number is associated, as indicated by block 318. The gaming system removes the accumulated free play indicator from the set of free play indicators, as indicated by block 320. The gaming system increases the quantity of plays (such as by one play), as indicated by block 322. The gaming system determines whether the gaming system keno number set includes a designated quantity of keno numbers (i.e., determines whether the gaming system has completed forming the gaming system keno number set), as indicated by diamond 324. If the gaming system determines at diamond 324 that the gaming system keno number set does not include the designated quantity of keno numbers, the process 300 returns to block 310.

If, on the other hand, the gaming system determines at diamond 324 that the gaming system keno number set includes the designated quantity of keno numbers, the gaming system determines any bonus awards based on a comparison of the player keno number set with the gaming system keno number set, as indicated by block 326. The gaming system displays any determined bonus awards, as indicated by block 328. The gaming system reduces the quantity of plays (such as by one), as indicated by block 330.

The gaming system determines whether a designated quantity of free play indicators of the set of free play indicators (such as all of the free play indicators of the set of free play indicators) has been accumulated, as indicated by diamond 332. If the gaming system determines at diamond 332 that the designated quantity of free play indicators of the set of free play indicators has not been accumulated, the process 300 proceeds to diamond 336, described below. If, on the other hand, the gaming system determines at diamond 332 that the designated quantity of free play indicators of the set of free play indicators has been accumulated, the gaming system returns each accumulated free play indicator to the set of free play indicators, as indicated by block 334.

The gaming system determines whether the quantity of plays is at least one, as indicated by diamond 336. If the gaming system determines at diamond 336 that the quantity of plays is at least one, the process 300 returns to block 304 for another play. If, on the other hand, the gaming system determines at diamond 336 that the quantity of plays is not at least one, the gaming system ends the bonus game.

FIGS. 4A, 4B, 4C, 4D, 4E, 4F, 4G, 4H, and 4I illustrate screen shots of an example embodiment of the gaming system of the present disclosure configured to operate one example of the Queen Bonus (i.e., a keno-type bonus game) of the present disclosure. In this example embodiment, the gaming system triggers the Queen Bonus when six Queen designated values have been accumulated in association with a plurality of plays of the above-described keno-type primary game. It should be appreciated that the operation of the King Bonus, the Jack Bonus, and the Ace Bonus are substantially the same as the operation of the Queen Bonus, except being associated with different quantities of free play indicators.

In this example embodiment, the Queen Bonus is associated with: (1) one free play; (2) a set of keno numbers including the numbers 1 through 80 (though it should be appreciated that the Queen Bonus may be associated with any suitable numbers or range of numbers and/or any suitable symbols (such as letters, characters, themed images, and the like) instead of or in addition to numbers); and (3) a designated quantity of six free play indicators (which is equal to the designated quantity of Queen designated values required to be accumulated to trigger the Queen Bonus).

In this example embodiment, the gaming system displays (such as on a display device 1116 or 1118, described below) a grid 400 that includes a plurality of keno number positions (not labeled for clarity). The gaming system displays a different one of the keno numbers of the set of keno numbers 1 through 80 at each of the keno number positions.

In this example embodiment, the gaming system also displays a free play indicator accumulation area 430. The free play indicator accumulation area 430 includes six free play indicator display areas 430*a*, 430*b*, 430*c*, 430*d*, 430*e*, and 430*f* configured to display an accumulated free play indicator. In this example embodiment, the quantity of free play indicator display areas is equal to the designated quantity of free play indicators associated with the Queen Bonus.

In this example embodiment, the gaming system also displays a free plays remaining indicator 440 that indicates the type of Bonus, the quantity of free plays already played, and the total quantity of free plays (which includes the quantity of free plays already played and any remaining free plays). It should be appreciated that the gaming system may indicate the quantity of remaining free plays in any suitable manner.

In this example embodiment, the gaming system also displays a paytable 470 that indicates a plurality of quantities of "Hits" and a corresponding award amount for each "Hit". In this example embodiment, the quantity of "Hits" included in the paytable 470 and the corresponding award amounts are determined based on a player keno number set including ten keno numbers and a bet of 8 credits. Here, the Queen Bonus is provided with an effective bet of 8 credits, which matches the bet of the play of the keno-type primary game in which the Queen Bonus was triggered.

The gaming system also displays: (a) a plurality of meters including: (i) an award meter 482 that displays any awards won for a free play of the Queen Bonus (in credit or currency form); (ii) a bet meter 484 that displays the effective bet for the free play(s) of the Queen Bonus (in credit or currency form), and (iii) a credit meter 486 that displays the credit balance of the player (in credit or currency form); and (b) a plurality of buttons actuatable by the player including: (i) a Start button 492 that, when actuated by the player, causes the gaming system to initiate a free play of the Queen Bonus; (ii) a Clear button 494 that, when actuated by the player, causes the gaming system to remove any keno numbers from the player keno number set; and (iii) a Quick Pick button 496 that, when actuated by the player, causes the gaming system to randomly determine which keno numbers to include in the player keno number set.

Figure 4A:
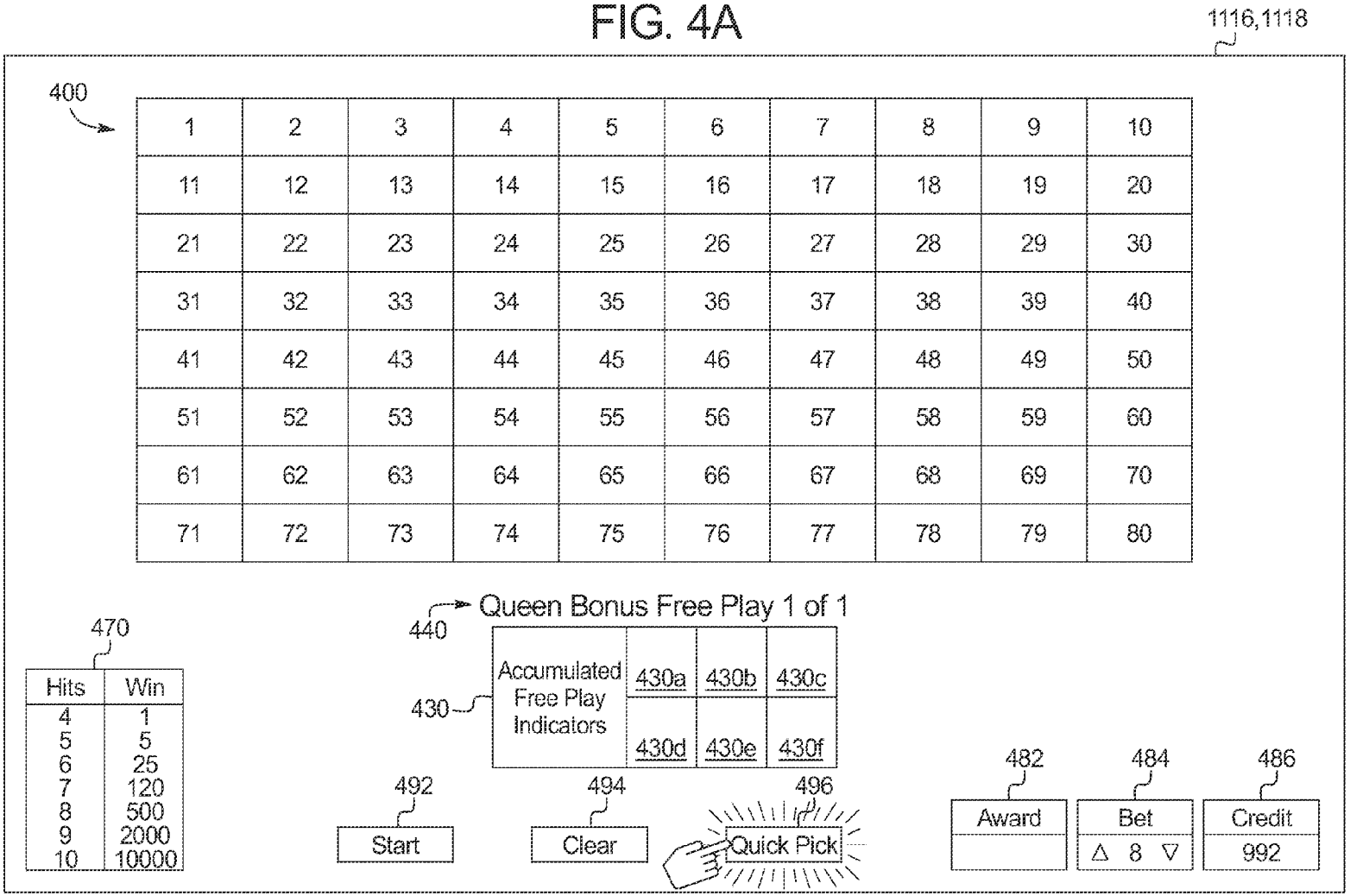

Turning to FIG. 4A, the gaming system provides the first free play of the Queen Bonus and enables the player to select which of the keno numbers to include in the player keno number set. More specifically, in this example embodiment, the gaming system enables the player to: (1) manually select between two and ten of the keno numbers to include in the player keno number set (such as via a touch screen or a dedicated button or buttons, described below), or (2) actuate the Quick Pick button 496 to cause the gaming system to randomly select ten of the keno numbers to include in the player keno number set. Here, the gaming system receives an actuation of the Quick Pick button 496.

Figure 4B:
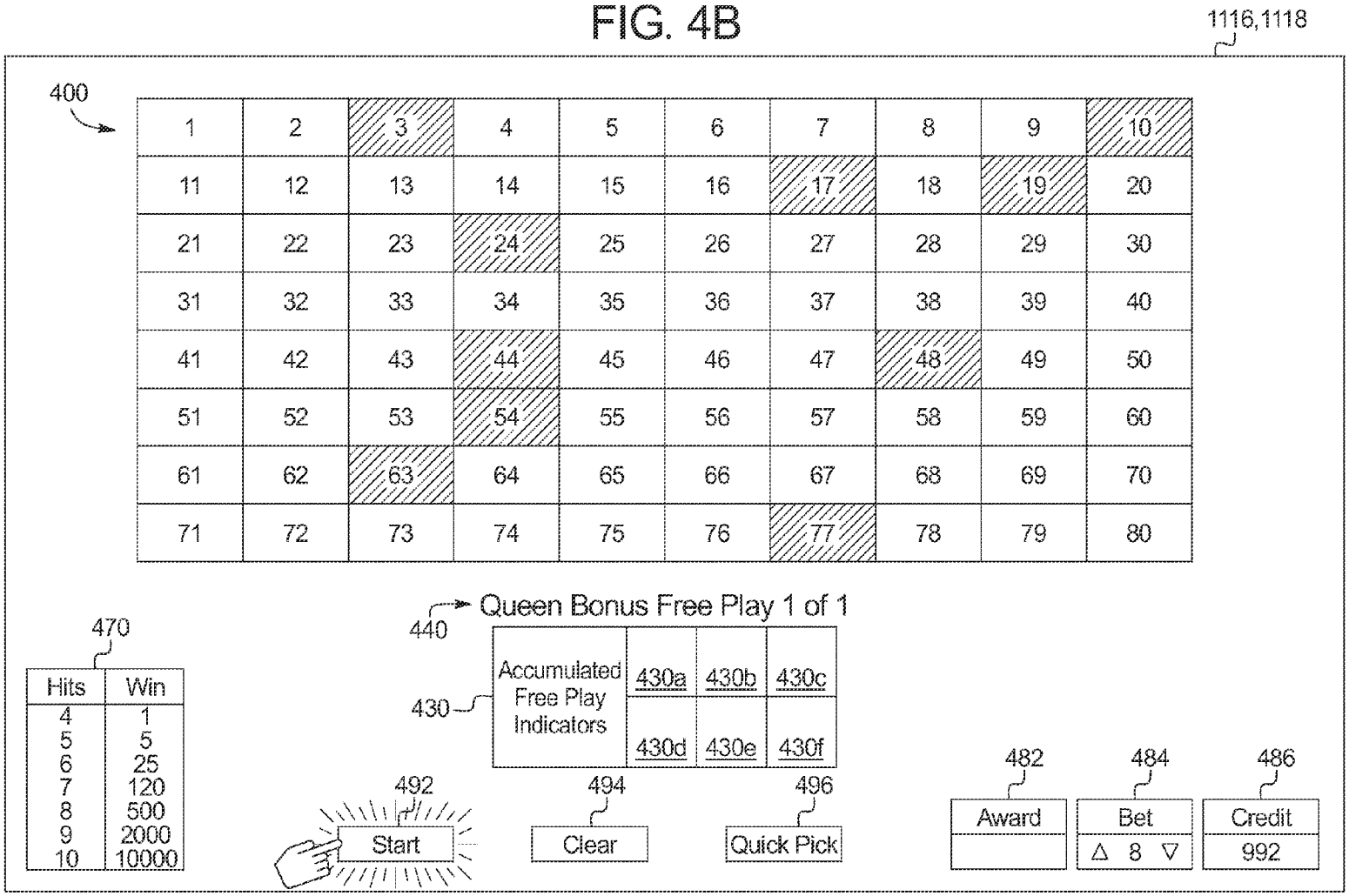

As shown in FIG. 4B, upon receiving the actuation of the Quick Pick button 496, the gaming system randomly selects the keno numbers 3, 10, 17, 19, 24, 44, 48, 54, 63, and 77 to include in the player keno number set. In this example embodiment, the gaming system displays a hatch pattern in each of the keno number positions corresponding to the keno numbers of the player keno number set for clarity, though it should be appreciated that the gaming system may indicate the keno numbers of the player keno number set in any suitable manner, such as by shading each of the corresponding keno number positions, coloring each of the corresponding keno number positions, displaying an icon in each of the corresponding keno number positions, changing the typeface used for the corresponding keno number positions, and the like. After the gaming system forms the player keno number set, the gaming system receives an actuation of the Start button 492 from the player.

Figure 4C:
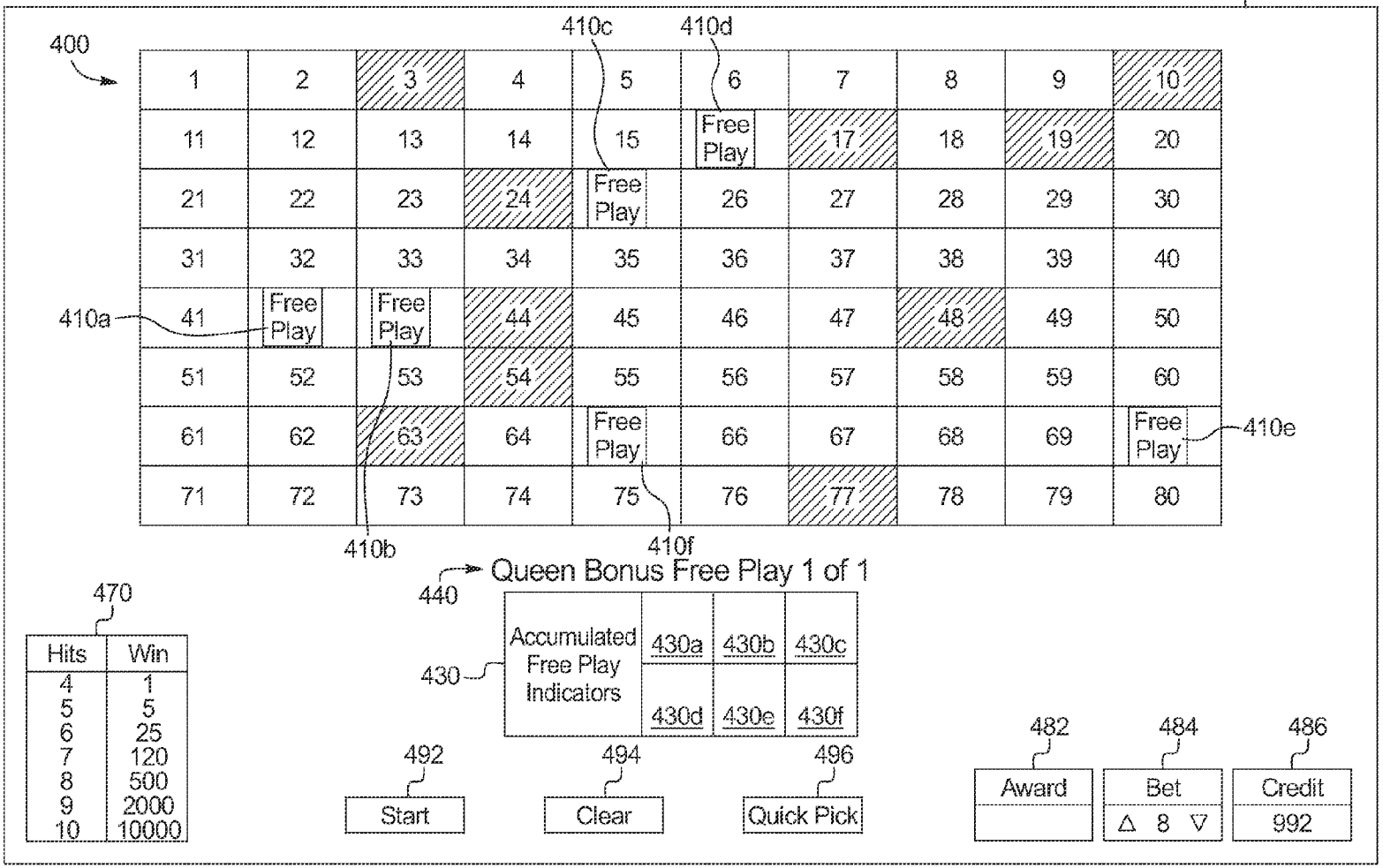

As shown in FIG. 4C, upon receipt of the actuation of the Start button 492, for each non-accumulated free play indicator (which, at this point, includes all of the free play indicators), the gaming system: (1) selects one of the keno numbers not included in the player keno number set and not already associated with a free play indicator, and (2) displays that free play indicator at the keno number position of the selected keno number. In this example embodiment, the gaming system displays the free play indicator 410*a* at the keno number position associated with the keno number 42, displays the free play indicator 410*b* at the keno number position associated with the keno number 43, displays the free play indicator 410*c* at the keno number position associated with the keno number 25, displays the free play indicator 410*d* at the keno number position associated with the keno number 16, displays the free play indicator 410*e* at the keno number position associated with the keno number 70, and displays the free play indicator 410*f* at the keno number position associated with the keno number 65.

Figure 4D:
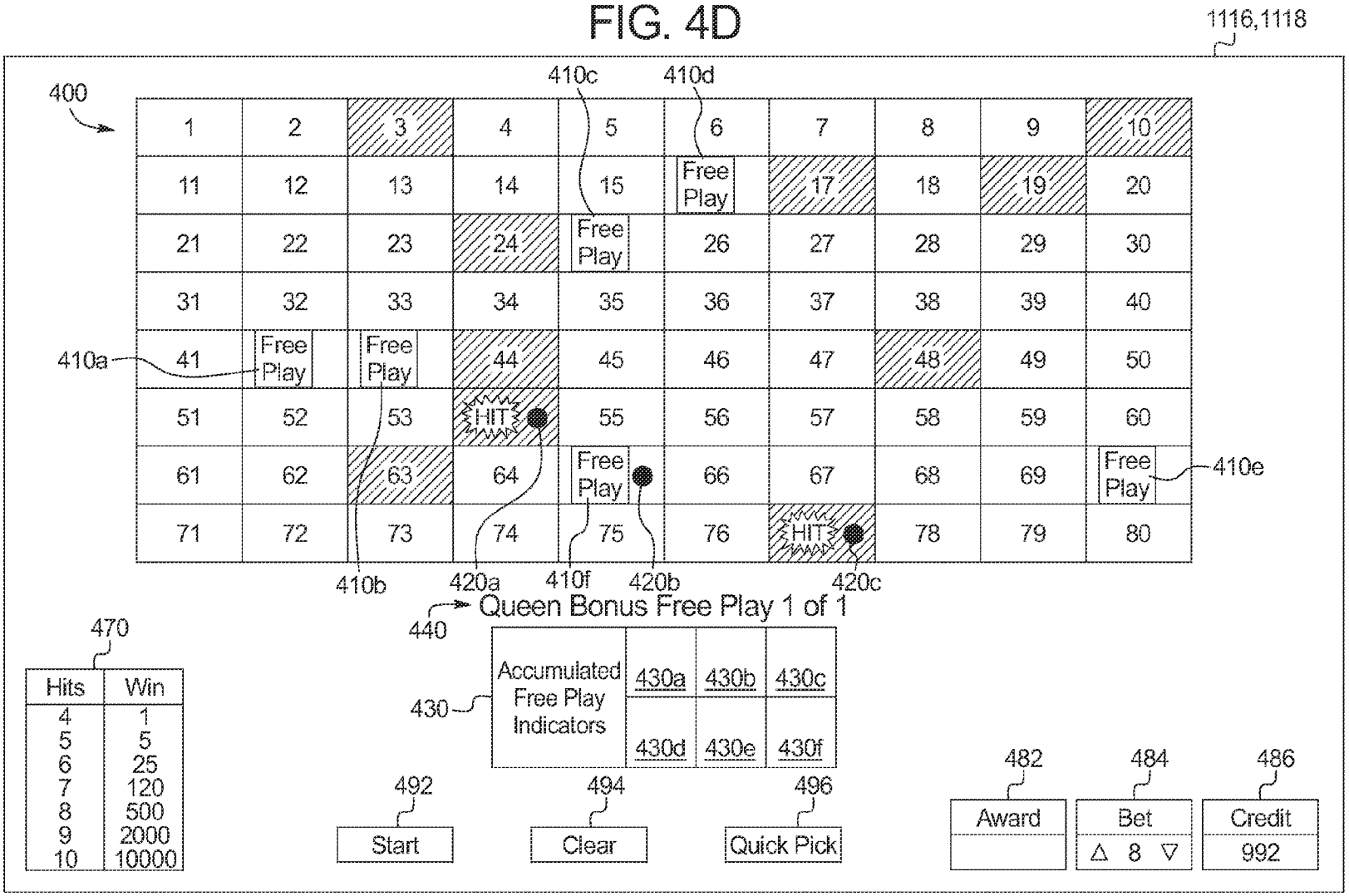

As shown in FIG. 4D, after associating the non-accumulated free play indicators with the different keno numbers, the gaming system begins sequentially selecting the twenty keno numbers to include in the gaming system keno number set. At this point, the gaming system has previously selected the keno numbers 54 and 77 to include in the gaming system keno number set and has most recently selected the keno number 65, which is associated with the free play indicator 410*f*, to include in the gaming system keno number set. In this example embodiment, the gaming system displays an indicator (such as a ball icon) in the keno number position of each keno number included in the gaming system keno number set, though it should be appreciated that the gaming system may indicate the keno numbers included in the gaming system keno number set in any suitable manner. Here, the gaming system displays an indicator 420*a* in the keno number position of the keno number 54, an indicator 420*b* in the keno number position of the keno number 65, and an indicator 420*c* in the keno number position associated with the keno number 77.

In this example embodiment, when the gaming system selects a keno number associated with a non-accumulated free play indicator to include in the gaming system keno number set, the gaming system: (1) adds the selected keno number to the gaming system keno number set, (2) accumulates the associated non-accumulated free play indicator by displaying the associated non-accumulated free play indicator at an unoccupied free play indicator display area of the free play indicator accumulation area 430, and (3) increases the total quantity of free plays by one. Thus, in this example embodiment, the accumulation of a non-accumulated free-play indicator during a free play of the Queen Bonus causes the gaming system to provide an additional free play.

Figure 4E:
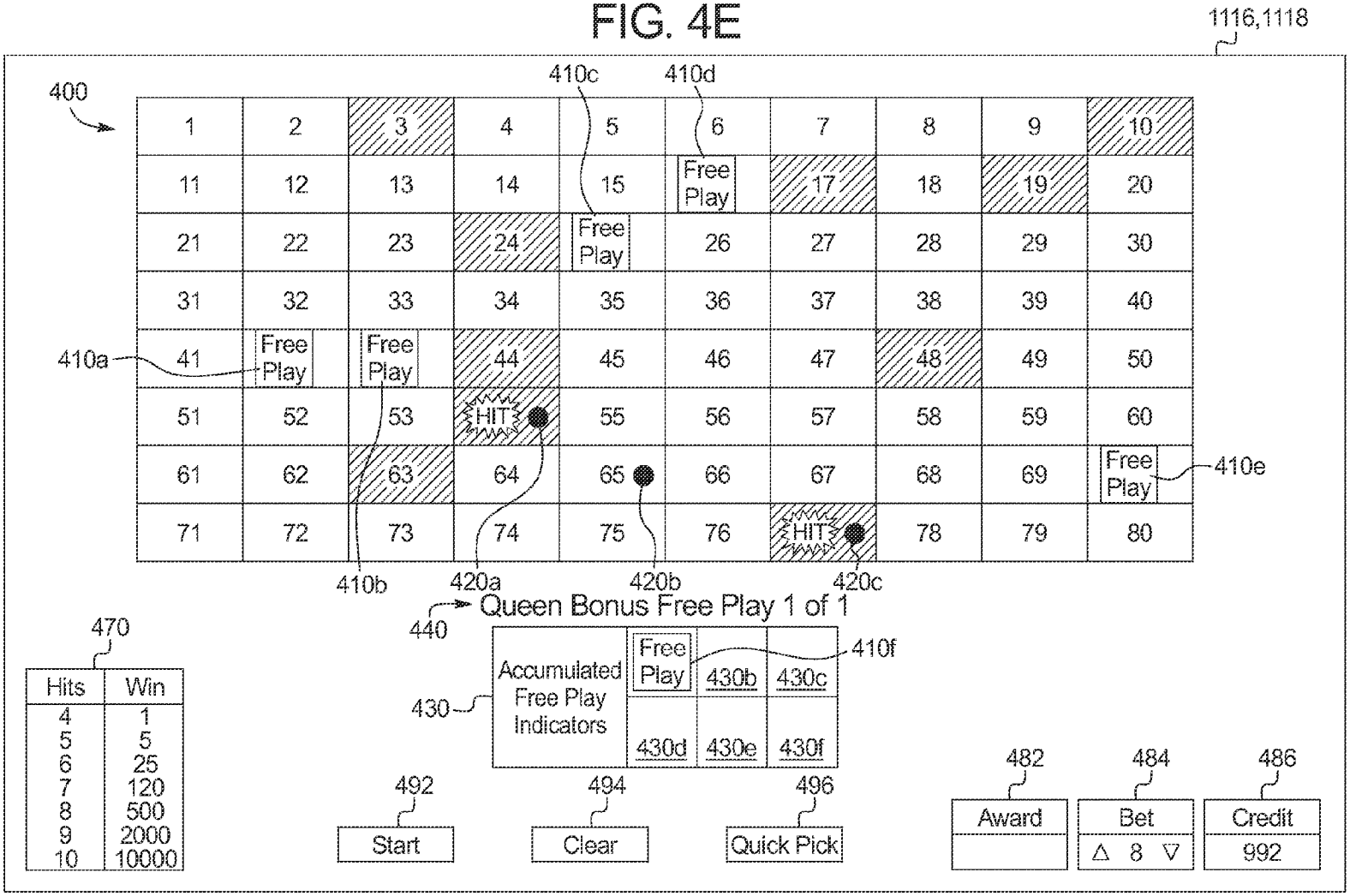

As shown in FIG. 4E, because the gaming system selected the keno number 65 associated with the free play indicator 410*f*, the gaming system: (1) adds the keno number 65 to the gaming system keno number set, (2) accumulates the free play indicator 410*f* by displaying the free play indicator 410*f* at the free play indicator display area 430*a* of the free play indicator accumulation area 430, and (3) increases the total quantity of free plays by one from one to two. In this example embodiment, the gaming system removes the accumulated free play indicator 410*f* from the keno position of the keno number 65 with which the accumulated free play indicator was associated, though it should be appreciated that, in other embodiments, the gaming system continues to display the free play indicator at the keno number position associated with the corresponding keno number after accumulating that free play indicator.

Figure 4F:
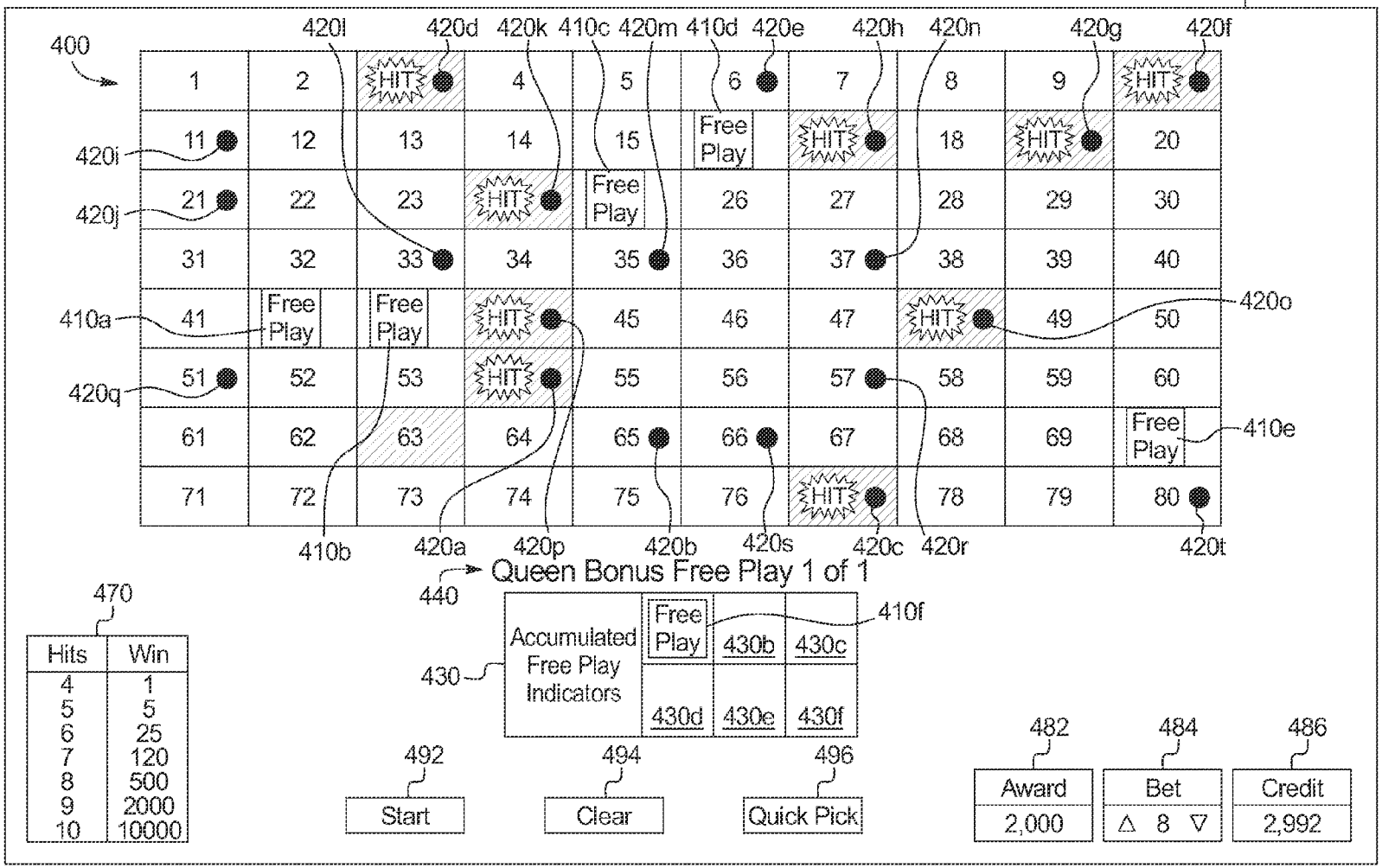

As shown in FIG. 4F, the gaming system has selected seventeen additional keno numbers 3, 6, 10, 11, 17, 19, 21, 24, 33, 35, 37, 44, 48, 51, 57, 66, and 80 to include in and complete the gaming system keno number set. The gaming system displays an indicator 420*d* in the keno number position of the keno number 3, an indicator 420*e* in the keno number position of the keno number 6, an indicator 420*f* in the keno number position of the keno number 10, an indicator 420*i* in the keno number position of the keno number 11, an indicator 420*h* in the keno number position of the keno number 17, an indicator 420*g* in the keno number position associated with the keno number 19, an indicator 420*j* in the keno number position associated with the keno number 21, an indicator 420*k* in the keno number position associated with the keno number 24, an indicator 420*l* in the keno number position associated with the keno number 33, an indicator 420*m* in the keno number position associated with the keno number 35, an indicator 420*n* in the keno number position associated with the keno number 37, an indicator 420*p* in the keno number position associated with the keno number 44, an indicator 420*o* in the keno number position associated with the keno number 48, an indicator 420*q* in the keno number position associated with the keno number 51, an indicator 420*r* in the keno number position associated with the keno number 57, an indicator 420*s* in the keno number position associated with the keno number 66, and an indicator 420*t* in the keno number position associated with the keno number 80.

None of these additional seventeen selected keno numbers is associated with a non-accumulated free play indicator.

The gaming system makes an award determination for the free play of the Queen Bonus by determining how many "Hits" occurred, as described above. In this instance, nine "Hits" occurred because the keno numbers 3, 10, 17, 19, 24, 44, 48, 54, and 77 are each included in both the player keno number set and the gaming system keno number set. The gaming system determines based on the paytable 270 that a quantity of nine "Hits" is associated with an award amount of 2,000 credits; displays the 2,000 credit award in the award meter 482; and increases the player's credit balance (displayed in the credit mete 486) by the 2,000 credit award from 992 credits to 2,992 credits.

Figure 4G:
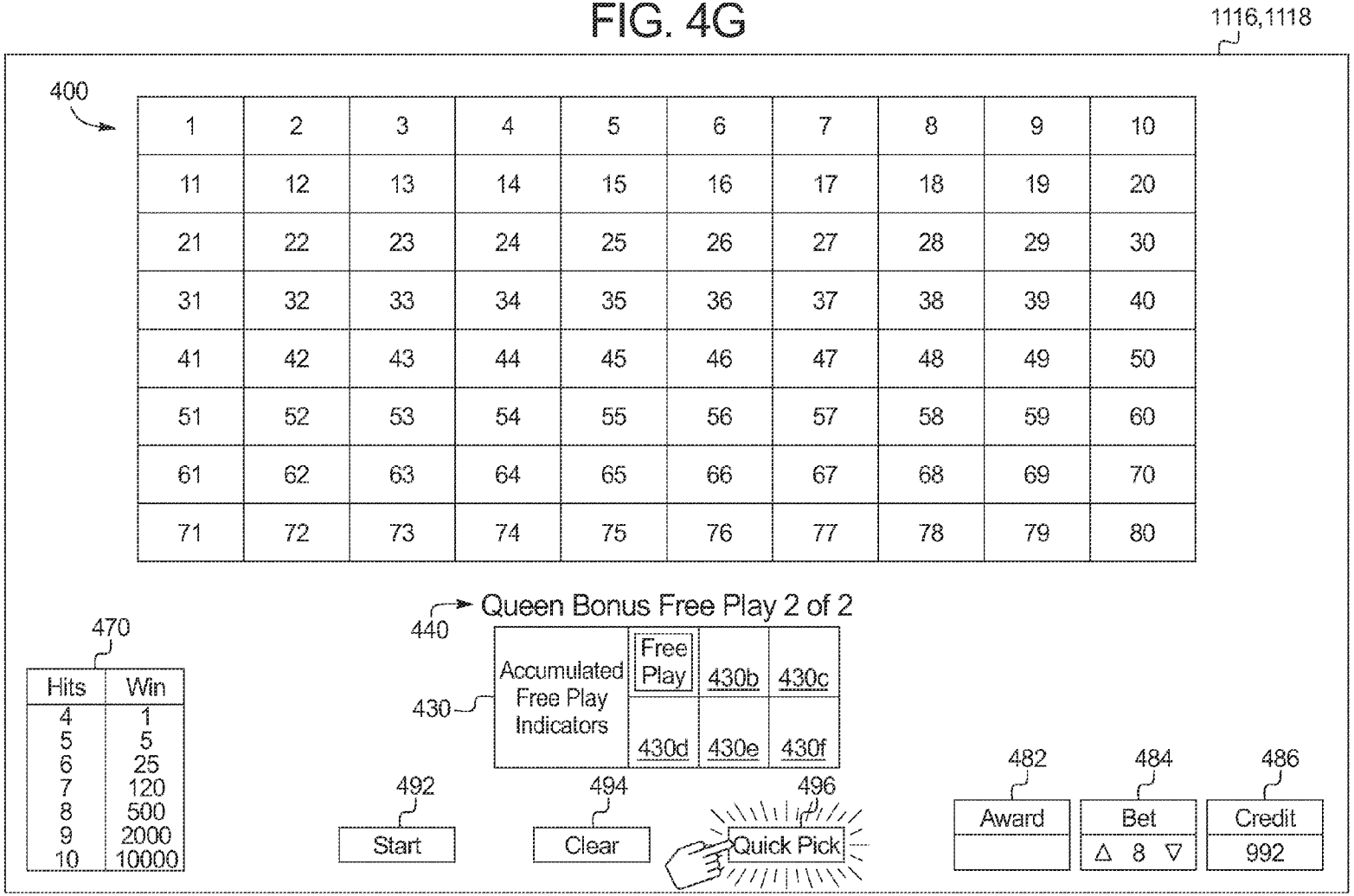

Since at least one free play remains, the gaming system provides another free play of the Queen Bonus. Turning to FIG. 4G, the gaming system enables the player to select which of the keno numbers to include in the player keno number set. The gaming system receives an actuation of the Quick Pick button 496.

Figure 4H:
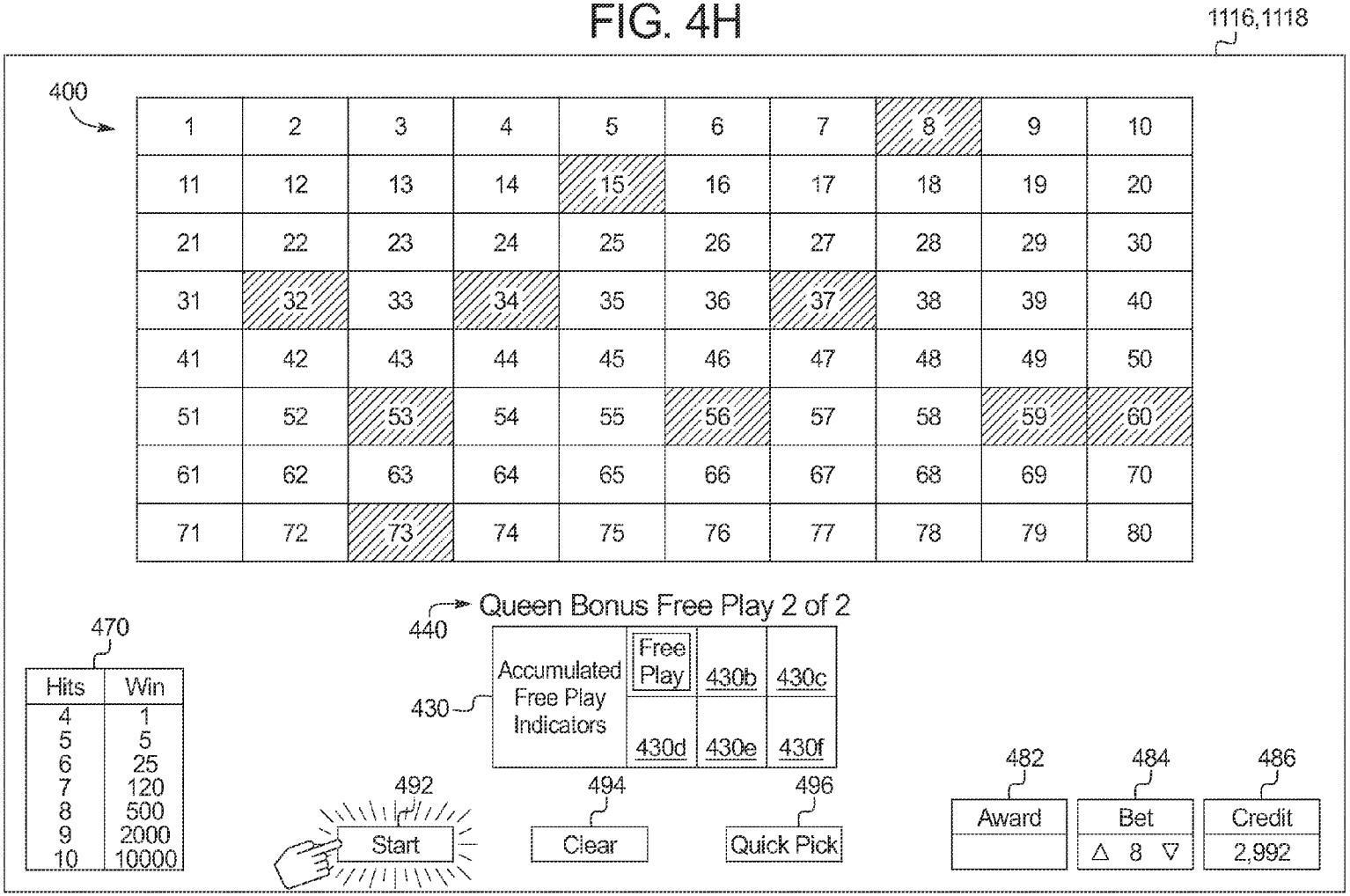
Figure 41:
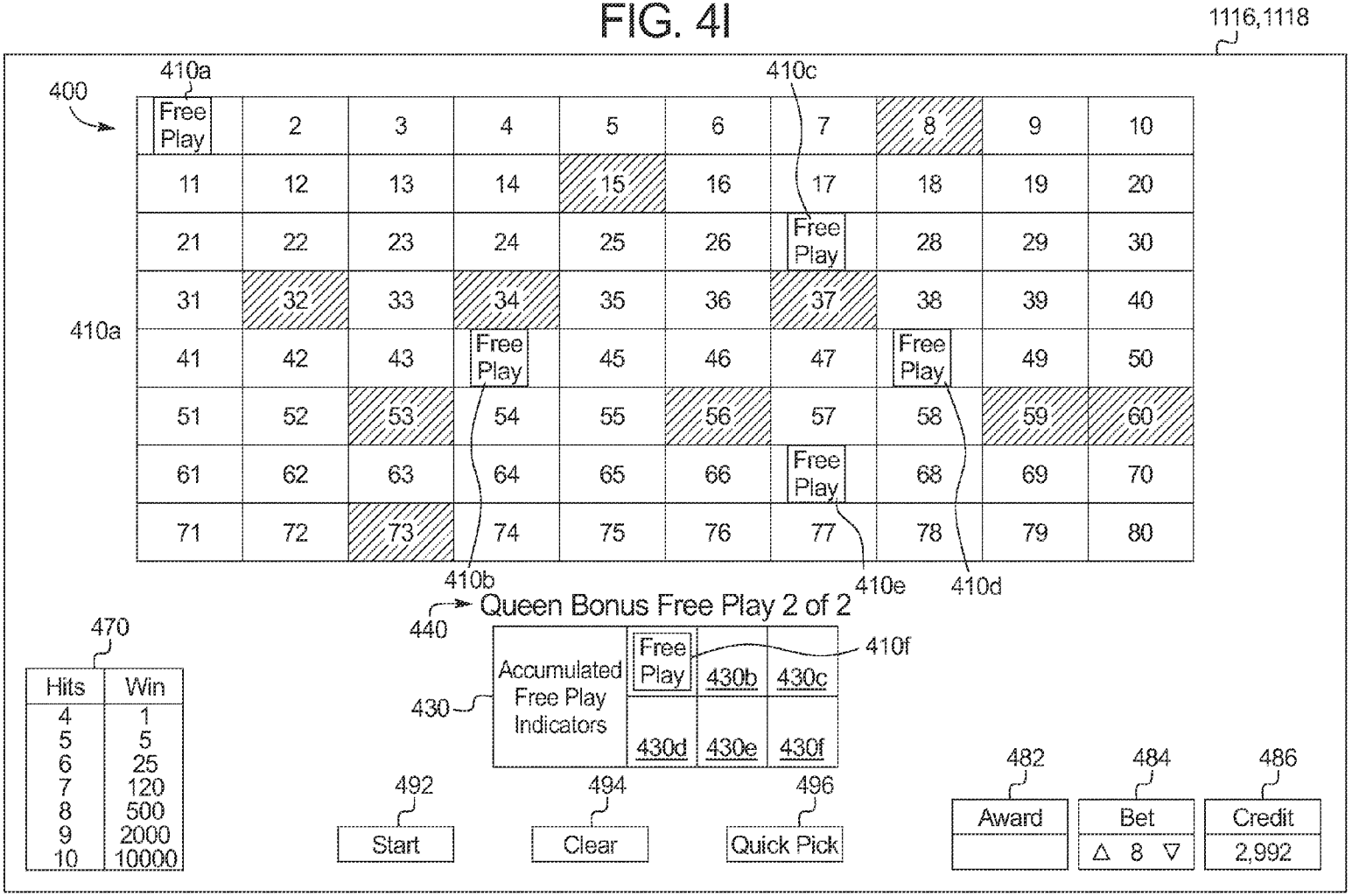

As shown in FIG. 4H, upon receiving the actuation of the Quick Pick button 496, the gaming system randomly selects the keno numbers 8, 15, 32, 34, 37, 53, 56, 59, 60, and 73 to include in the player keno number set. After the gaming system forms the player keno number set, the gaming system receives an actuation of the Start button 492 from the player.

As shown in FIG. 4I, upon receipt of the actuation of the Start button 492, for each non-accumulated free play indicator (which, includes the five non-accumulated free play indicators 410*a*, 410*b*, 410*c*, 410*d*, and 410*e*), the gaming system: (1) selects one of the keno numbers not included in the player keno number set, and (2) displays that free play indicator at the keno number position of the selected keno number. In this example embodiment, the gaming system displays the free play indicator 410*a* at the keno number position associated with the keno number 1, displays the free play indicator 410*b* at the keno number position associated with the keno number 44, displays the free play indicator 410*c* at the keno number position associated with the keno number 27, displays the free play indicator 410*d* at the keno number position associated with the keno number 48, and displays the free play indicator 410*e* at the keno number position associated with the keno number 67. It should be appreciated that as more free play indicators are accumulated, the probability of accumulating a free play indicator during a free play of the Queen Bonus decreases.

Although not shown, in this example embodiment, if the player accumulates a designated quantity of the free play indicators (such as all of the free play indicators) during the Queen Bonus, the gaming system resets the accumulated free play indicators to non-accumulated free play indicators.

In various embodiments, the gaming system may associate a plurality of non-accumulated free play indicators with a particular keno number during a play of the keno-type bonus game. For instance, the gaming system may associate a first free play indicator with keno number 23 at a first point time during the play of the keno-type bonus game and a second different free play indicator with keno number 23 at a second subsequent point in time during the play of the keno-type bonus game.

In certain embodiments, the gaming system may associate one or more non-accumulated free play indicators with one or more keno numbers in the player number set. For instance, in one example embodiment in which the keno number 19 is in the player number set, the gaming system randomly selects and associates a free play indicator with the keno number 19. In one such embodiment, if the gaming system associates a non-accumulated free play indicator with a keno number included in the player number set, the gaming system: (1) accumulates the associated free play indicator by displaying the associated free play indicator at an unoccupied free play indicator display area of the free play indicator accumulation area 430, and (2) increases the total quantity of free plays by one.

In various embodiments, the gaming system provides one or more additional free play indicators upon an occurrence of a triggering event that occurs during play of the keno-type bonus game. For instance, in one example embodiment, the gaming system provides an additional free play indicator and associates the additional free play indicator with a randomly selected keno number when a designated quantity of "Hits" occur. For example, if five "Hits" occur before the gaming system finishes forming the gaming system number set, the gaming system provides an additional free play indicator.

In certain embodiments, the gaming system does not remove an free play indicator from the set of free play indicators when the gaming system accumulates that free play indicator.

In various embodiments, the keno-type bonus game is associated with a maximum quantity of free plays. In these embodiments, once the gaming system provides the maximum quantity of free plays during play of the keno-type bonus game, the gaming system ends the keno-type bonus game.

In another embodiment, the gaming system does not increase the quantity of free plays when the gaming system accumulates a free play indicator. Rather, in this embodiment, when gaming system increases the quantity of free plays when a designated quantity of (such as all of) the free play indicators have been accumulated.

It should be appreciated that the keno-type bonus game may be triggered via a mystery trigger or via play of a game other than the above-described keno-type primary game. It should also be appreciated that the keno-type bonus game may be triggered via any suitable triggering event.

It should be appreciated that:

(a) the quantity of free play indicators associated with the keno-type bonus game;
(b) the initial quantity of free plays associated with the keno-type bonus game;
(c) the keno numbers with which the free play indicators are associated;
(d) the quantity of additional free plays to provide when a free play indicator is accumulated;
(e) the type of values
(f) the quantity of keno numbers in the player keno number set;
(g) the particular keno numbers in the player keno number set;
(h) the quantity of keno numbers in the gaming system keno number set;
(i) the particular keno numbers in the gaming system keno number set;
(j) the keno number with which a particular free play indicator is associated; and/or
(k) any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level;

(17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
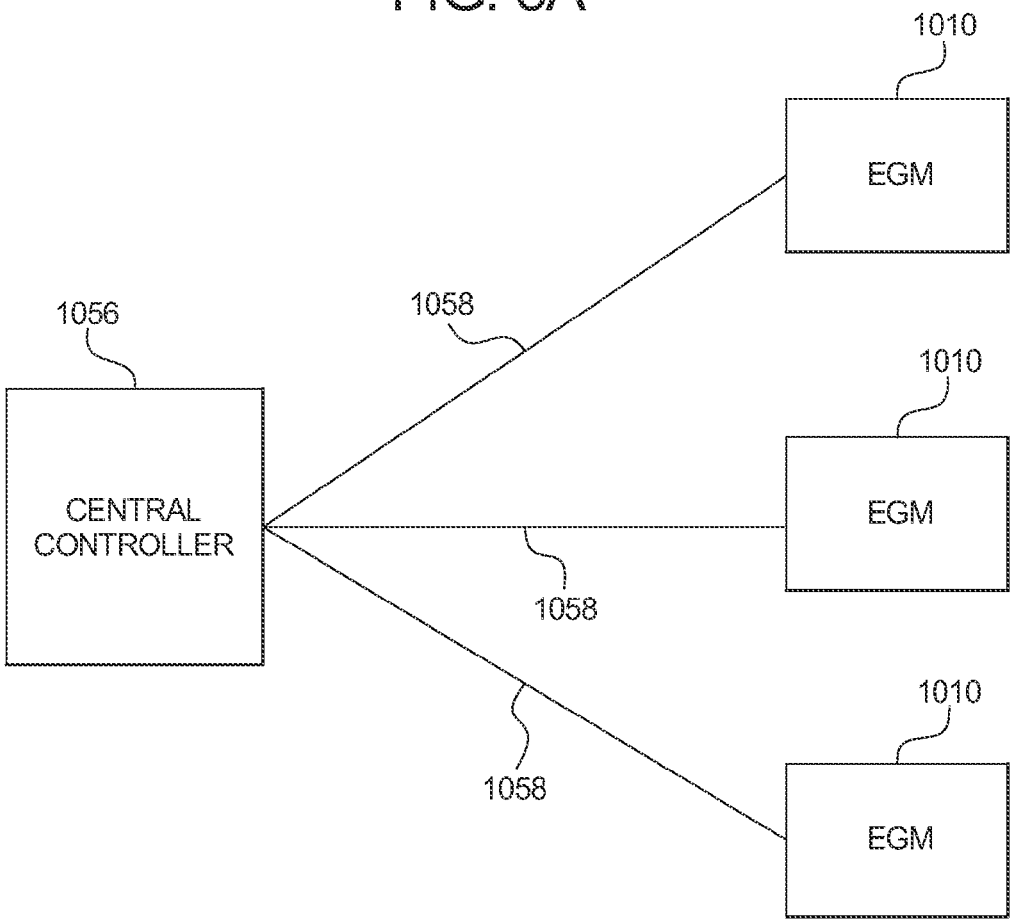
FIG. 5A is a schematic block diagram of an example network configuration of one embodiment of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
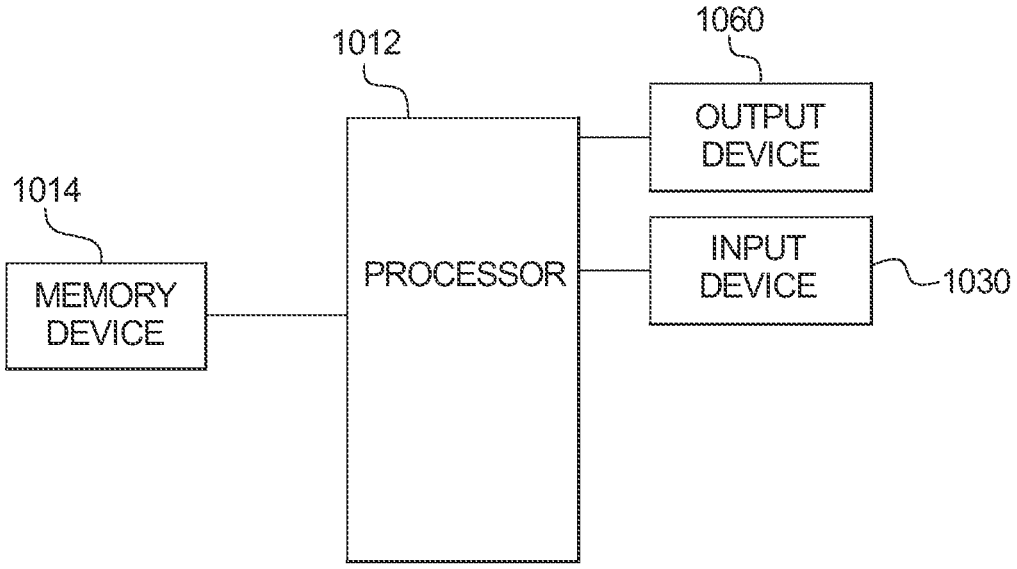
FIG. 5B is a schematic block diagram of an example electronic configuration of a gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
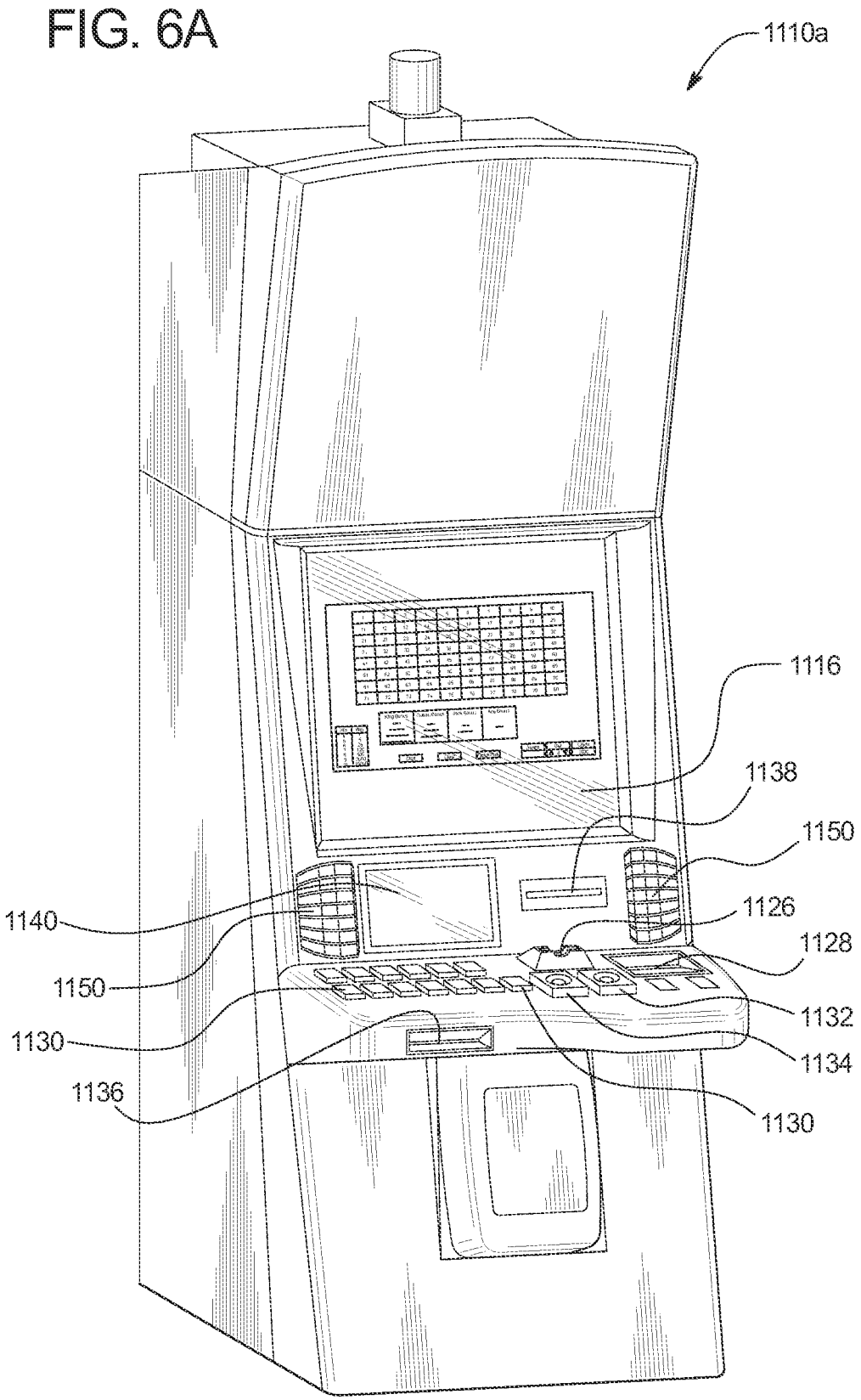
FIGS. 6A and 6B are perspective views of example alternative embodiments of gaming systems of the present disclosure.
Figure 6B:
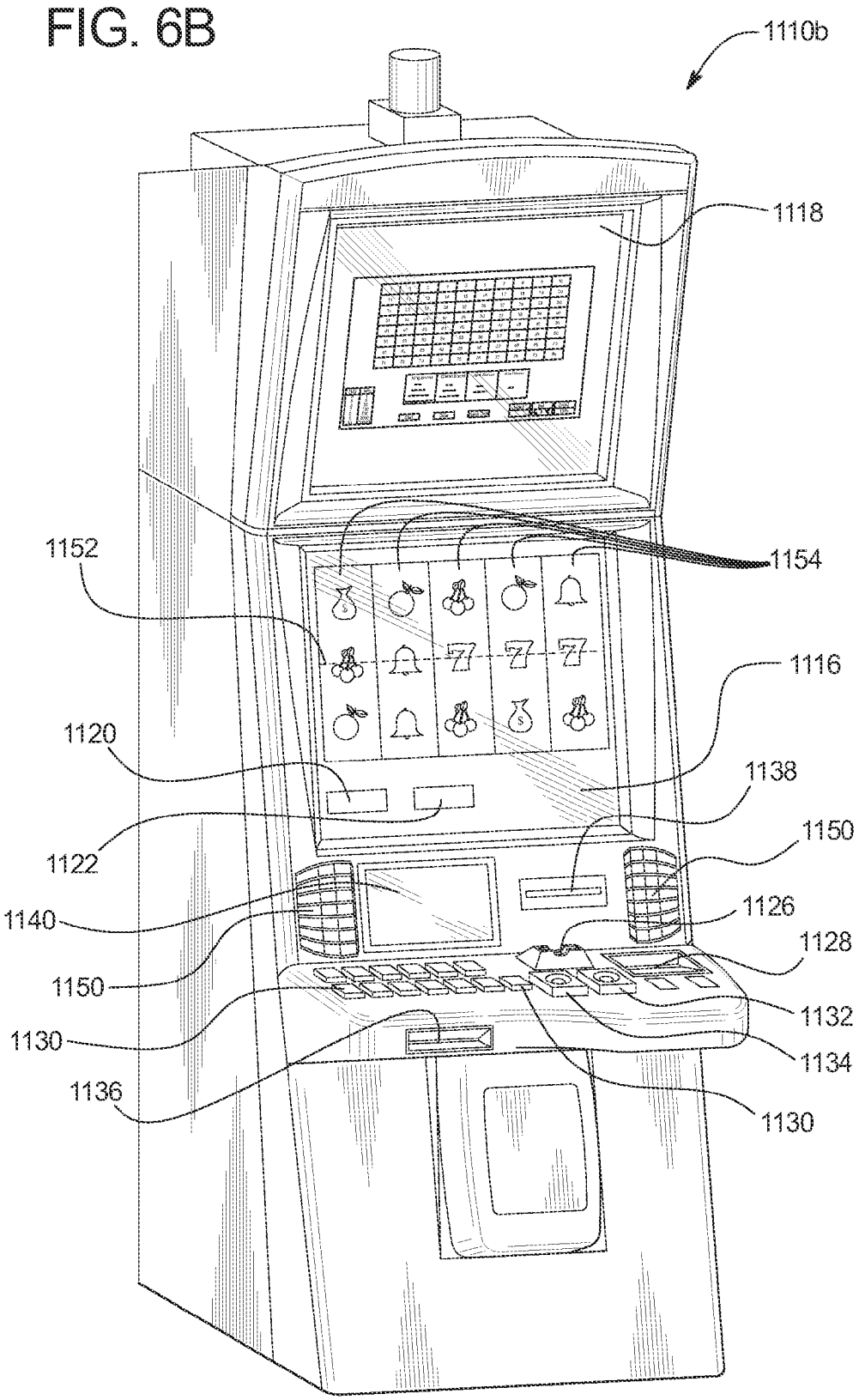

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 6A and 6B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 6A and 6B each include one or more input devices 1130.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 1110*a* illustrated in FIG. 6A includes a central display device 1116, a player tracking display 1140, a credit display 1120, and a bet display 1122. The example EGM 1110*b* illustrated in FIG. 6B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electromechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM 1110*b* shown in FIG. 6B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

at least one processor;

at least one display device;

a plurality of input devices including:

(i) an acceptor, and (ii) a cashout device; and at least one memory device that stores a plurality of instructions that, when executed by the at least one processor, cause the at least one processor to operate with the at least one display device and the plurality of input devices to:

(a) if a physical item is received via the acceptor, establish a credit balance based, at least in part, on a monetary value associated with the received physical item (b) display a set of a plurality of different keno numbers;

(c) form a player keno number set including one or more keno numbers of the set of the plurality of different keno numbers;

(d) select a value of a set of a plurality of values, the set of the plurality of values including a first subset of one or more designated values and a second subset of one or more non-designated values, each designated value of the first subset of one or more designated values being associated with one of a plurality of different persistence pools;

(e) associate the selected value with a keno number in the set of the plurality of different keno numbers;

(f) select a keno number in the set of the plurality of different keno numbers;

(g) add the selected keno number to a gaming system keno number set;

(h) if the selected keno number is associated with a designated value of the first subset of one or more designated values, increment the persistence pool associated with the designated value with which the selected keno number is associated;

(i) repeat (f) to (h) until the gaming system keno number set includes a designated quantity of keno numbers;

(j) determine any primary awards based on a comparison of the player keno number set with the gaming system keno number set;

(k) display any determined primary awards;

(l) for each persistence pool, if said persistence pool has been incremented to a designated value, provide a bonus associated with said persistence pool; and (m) if a cashout input is received via the cashout device, cause an initiation of any payout associated with the credit balance.

2. The gaming system of claim 1, wherein the plurality of instructions, when executed by the at least one processor, cause the at least one processor to, if the selected keno number is associated with a designated value of the first subset of one or more designated values, increment the persistence pool associated with the designated value with which the selected keno number is associated by accumulating the designated value with which the selected keno number is associated.

3. The gaming system of claim 1, wherein at least two different persistence pools are associated with different designated values.

4. The gaming system of claim 1, wherein the plurality of instructions, when executed by the at least one processor, cause the at least one processor to, if the selected keno number is associated with a non-designated value of the second subset of one or more non-designated values:

(i) select a designated quantity of values of the set of the plurality of values, and (ii) associate each selected value with a keno number in the set of the plurality of different keno numbers.

5. The gaming system of claim 1, wherein the bonus includes a bonus game including a quantity of plays, and the plurality of instructions, when executed by the at least one processor, cause the at least one processor to operate with the at least one display device to, for each persistence pool, if said persistence pool has been incremented to the designated value, provide the bonus associated with said persistence pool by:

(1) displaying a set of a plurality of different keno numbers;

(2) forming a player keno number set including one or more keno numbers of the set of the plurality of different keno numbers;

(3) associating each of a set of one or more free play indicators with a number in the set of the plurality of different keno numbers;

(4) selecting a keno number in the set of the plurality of different keno numbers;

(5) adding the selected keno number to a gaming system keno number set;

(6) if the selected keno number is associated with a free play indicator of the set of one or more free play indicators:

(i) accumulating the free play indicator with which the selected keno number is associated, (ii) removing the accumulated free play indicator from the set of free play indicators, and (iii) increasing the quantity of plays;

(7) repeating (4) to (6) until the gaming system keno number set includes a designated quantity of keno numbers;

(8) determining any bonus awards based on a comparison of the player keno number set with the gaming system keno number set;

(9) displaying any determined bonus awards;

(10) reducing the quantity of plays;

(11) if a designated quantity of free play indicators of the set of one or more free play indicators has been accumulated, returning each accumulated free play indicator to the set of one or more free play indicators; and

(12) if the quantity of plays is at least one, repeating (1) to (11).

6. The gaming system of claim 5, wherein the set of one or more free play indicators includes a quantity of free play indicators determined based on the persistence pool associated with the provided bonus.

7. A method of operating a gaming system, said method comprising:

(a) causing at least one processor to operate with at least one display device to display a set of a plurality of different keno numbers;

(b) causing the at least one processor to form a player keno number set including one or more keno numbers of the set of the plurality of different keno numbers;

(c) causing the at least one processor to select a value of a set of a plurality of values, the set of the plurality of values including a first subset of one or more designated values and a second subset of one or more non-designated values, each designated value of the first subset of one or more designated values being associated with one of a plurality of different persistence pools;

(d) causing the at least one processor to associate the selected value with a keno number in the set of the plurality of different keno numbers;

(e) causing the at least one processor to select a keno number in the set of the plurality of different keno numbers;

(f) causing the at least one processor to add the selected keno number to a gaming system keno number set;

(g) if the selected keno number is associated with a designated value of the first subset of one or more designated values, causing the at least one processor to increment the persistence pool associated with the designated value with which the selected keno number is associated;

(h) repeating (e) to (g) until the gaming system keno number set includes a designated quantity of keno numbers;

(i) causing the at least one processor to determine any primary awards based on a comparison of the player keno number set with the gaming system keno number set;

(j) causing the at least one processor to operate with the at least one display device to display any determined primary awards, wherein a credit balance is increasable based on any determined primary awards, said credit balance being increasable via an acceptor of a physical item associated with a monetary value, and said credit balance being decreasable via a cashout device configured to receive an input to cause an initiation of a payout associated with the credit balance; and (k) for each persistence pool, if said persistence pool has been incremented to a designated value, providing a bonus associated with said persistence pool, wherein the credit balance is increasable based on the bonus associated with said persistence pool.

8. The method of claim 7, which includes causing the at least one processor to, if the selected keno number is associated with a designated value of the first subset of one or more designated values, increment the persistence pool associated with the designated value with which the selected keno number is associated by accumulating the designated value with which the selected keno number is associated.

9. The method of claim 7, wherein at least two different persistence pools are associated with different designated values.

10. The method of claim 7, which includes causing the at least one processor to, if the selected keno number is associated with a non-designated value of the second subset of one or more non-designated values:

(i) select a designated quantity of values of the set of the plurality of values, and (ii) associate each selected value with a keno number in the set of the plurality of different keno numbers.

11. The method of claim 7, wherein the bonus includes a bonus game including a quantity of plays, and which includes, for each persistence pool, if said persistence pool has been incremented to the designated value, providing the bonus associated with said persistence pool by:

(1) displaying a set of a plurality of different keno numbers;

(2) forming a player keno number set including one or more keno numbers of the set of the plurality of different keno numbers;

(3) associating each of a set of one or more free play indicators with a number in the set of the plurality of different keno numbers;

(4) selecting a keno number in the set of the plurality of different keno numbers;

(5) adding the selected keno number to a gaming system keno number set;

(6) if the selected keno number is associated with a free play indicator of the set of one or more free play indicators:

(i) accumulating the free play indicator with which the selected keno number is associated, (ii) removing the accumulated free play indicator from the set of free play indicators, and (iii) increasing the quantity of plays;

(7) repeating (4) to (6) until the gaming system keno number set includes a designated quantity of keno numbers;

(8) determining any bonus awards based on a comparison of the player keno number set with the gaming system keno number set;

(9) displaying any determined bonus awards;

(10) reducing the quantity of plays;

(11) if a designated quantity of free play indicators of the set of one or more free play indicators has been accumulated, returning each accumulated free play indicator to the set of one or more free play indicators; and

(12) if the quantity of plays is at least one, repeating (1) to (11).

12. The method of claim 11, wherein the set of one or more free play indicators includes a quantity of free play indicators determined based on the persistence pool associated with the provided bonus.

13. The method of claim 7, which is provided through a data network.

14. The method of claim 13, wherein the data network is an internet.

15. A non-transitory computer readable medium that stores a plurality of instructions that, when executed by at least one processor, cause the at least one processor to:

(a) cause at least one display device to display a set of a plurality of different keno numbers;

(b) form a player keno number set including one or more keno numbers of the set of the plurality of different keno numbers;

(c) select a value of a set of a plurality of values, the set of the plurality of values including a first subset of one or more designated values and a second subset of one or more non-designated values, each designated value of the first subset of one or more designated values being associated with one of a plurality of different persistence pools;

(d) associate the selected value with a keno number in the set of the plurality of different keno numbers;

(e) select a keno number in the set of the plurality of different keno numbers;

(f) add the selected keno number to a gaming system keno number set;

(g) if the selected keno number is associated with a designated value of the first subset of one or more designated values, increment the persistence pool associated with the designated value with which the selected keno number is associated;

(h) repeat (e) to (g) until the gaming system keno number set includes a designated quantity of keno numbers;

(i) determine any primary awards based on a comparison of the player keno number set with the gaming system keno number set;

(j) cause the at least one display device to display any determined primary awards, wherein a credit balance is increasable based on any determined primary awards, said credit balance being increasable via an acceptor of a physical item associated with a monetary value, and said credit balance being decreasable via a cashout device configured to receive an input to cause an initiation of a payout associated with the credit balance; and (k) for each persistence pool, if said persistence pool has been incremented to a designated value, provide a bonus associated with said persistence pool, wherein the credit balance is increasable based on the bonus associated with said persistence pool.

16. The non-transitory computer readable medium of claim 15, wherein the plurality of instructions, when executed by the at least one processor, cause the at least one processor to, if the selected keno number is associated with a designated value of the first subset of one or more designated values, increment the persistence pool associated with the designated value with which the selected keno number is associated by accumulating the designated value with which the selected keno number is associated.

17. The non-transitory computer readable medium of claim 15, wherein at least two different persistence pools are associated with different designated values.

18. The non-transitory computer readable medium of claim 15, wherein the plurality of instructions, when executed by the at least one processor, cause the at least one processor to, if the selected keno number is associated with a non-designated value of the second subset of one or more non-designated values:

(i) select a designated quantity of values of the set of the plurality of values, and (ii) associate each selected value with a keno number in the set of the plurality of different keno numbers.

19. The non-transitory computer readable medium of claim 15, wherein the bonus includes a bonus game including a quantity of plays, and the plurality of instructions, when executed by the at least one processor, cause the at least one processor to operate with the at least one display device to, for each persistence pool, if said persistence pool has been incremented to the designated value, provide the bonus associated with said persistence pool by:

(1) causing the at least one display device to display of a set of a plurality of different keno numbers;

(2) forming a player keno number set including one or more keno numbers of the set of the plurality of different keno numbers;

(3) associating each of a set of one or more free play indicators with a number in the set of the plurality of different keno numbers;

(4) selecting a keno number in the set of the plurality of different keno numbers;

(5) adding the selected keno number to a gaming system keno number set;

(6) if the selected keno number is associated with a free play indicator of the set of one or more free play indicators:

(i) accumulating the free play indicator with which the selected keno number is associated, (ii) removing the accumulated free play indicator from the set of free play indicators, and (iii) increasing the quantity of plays;

(7) repeating (4) to (6) until the gaming system keno number set includes a designated quantity of keno numbers;

(8) determining any bonus awards based on a comparison of the player keno number set with the gaming system keno number set;

(9) causing the at least one display device to display any determined bonus awards;

(10) reducing the quantity of plays;

(11) if a designated quantity of free play indicators of the set of one or more free play indicators has been accumulated, returning each accumulated free play indicator to the set of one or more free play indicators; and

(12) if the quantity of plays is at least one, repeating (1) to (11).

20. The non-transitory computer readable medium of claim 19, wherein the set of one or more free play indicators includes a quantity of free play indicators determined based on the persistence pool associated with the provided bonus.

* * * * *